US012329341B2

(12) United States Patent
Boyer et al.

(10) Patent No.: US 12,329,341 B2
(45) Date of Patent: Jun. 17, 2025

(54) DISHWASHER WITH RACK-MOUNTED TUBULAR SPRAY ELEMENT ASSEMBLY

(71) Applicant: Midea Group Co., Ltd., Foshan (CN)

(72) Inventors: Joel Boyer, Louisville, KY (US); Robert M. Digman, Goshen, KY (US)

(73) Assignee: Midea Group Co., Ltd., Guangdong (CN)

( * ) Notice: Subject to any disclaimer, the term of this patent is extended or adjusted under 35 U.S.C. 154(b) by 240 days.

(21) Appl. No.: 18/215,545

(22) Filed: Jun. 28, 2023

(65) Prior Publication Data

US 2025/0000327 A1 Jan. 2, 2025

(51) Int. Cl.

| | |
|---|---|
| ***A47L 15/22*** | (2006.01) |
| ***A47L 15/42*** | (2006.01) |
| ***A47L 15/50*** | (2006.01) |

(52) U.S. Cl.

CPC ..... *A47L 15/22* (2013.01); *A47L 15/4246* (2013.01); *A47L 15/4282* (2013.01); *A47L 15/50* (2013.01); *A47L 15/508* (2013.01)

(58) Field of Classification Search

None

See application file for complete search history.

(56) References Cited

U.S. PATENT DOCUMENTS

| | | | |
|---|---|---|---|
| 2,808,063 | A | 10/1957 | Abresch et al. |
| 2,907,335 | A | 10/1959 | Abresch |
| 2,992,779 | A | 1/1960 | James et al. |
| 2,939,465 | A | 6/1960 | Kesling |
| 2,956,572 | A | 10/1960 | Levit et al. |
| 2,973,907 | A | 3/1961 | Abresch et al. |
| 2,980,120 | A | 4/1961 | Jacobs |
| 3,006,557 | A | 10/1961 | Jacobs |
| 3,026,046 | A | 3/1962 | Wickham et al. |
| 3,044,842 | A | 7/1962 | Abresch et al. |
| 3,051,183 | A | 8/1962 | Jacobs |
| 3,077,200 | A | 2/1963 | Guth |
| 3,082,779 | A | 3/1963 | Jacobs |
| 3,088,474 | A | 5/1963 | Leslie |
| 3,101,730 | A | 8/1963 | Harris et al. |
| 3,115,306 | A | 12/1963 | Graham |
| 3,178,117 | A | 4/1965 | Hanifan |
| 3,192,935 | A | 7/1965 | Hanifan |

(Continued)

FOREIGN PATENT DOCUMENTS

| | | |
|---|---|---|
| CN | 2094961 U | 2/1992 |
| CN | 2395683 Y | 9/2000 |

(Continued)

OTHER PUBLICATIONS

Ayalew, Tinsae B., United States Patent and Trademark Office, Notice of Allowance issued in U.S. Appl. No. 17/323,350, 23 pages, dated Jun. 28, 2023.

(Continued)

*Primary Examiner* — Levon J Shahinian

(74) *Attorney, Agent, or Firm* — Gray Ice Higdon

(57) ABSTRACT

A rack-mounted tubular spray element assembly is capable of both rotating and supplying fluid to multiple rack-supported tubular spray elements when the rack is in a washing position that couples the rack-mounted tubular spray element assembly to a wall-supported and electrical motor-driven rotatable drive member and a wall-supported fluid port that is physically separated from the rotatable drive member.

20 Claims, 10 Drawing Sheets

(56) References Cited

U.S. PATENT DOCUMENTS 3,210,010 A 10/1965 Delapena
3,324,867 A 6/1967 Freese
3,348,775 A 10/1967 Flame
3,361,361 A 1/1968 Schutte
3,454,784 A 7/1969 Wantz et al.
3,538,927 A 11/1970 Wallgren
3,586,011 A 6/1971 Mazza
3,590,688 A 7/1971 Brannon
3,596,834 A 8/1971 Cushing
3,719,323 A 3/1973 Raiser
3,827,637 A 8/1974 Stephany et al.
3,854,665 A 12/1974 Rodgers
4,123,006 A 10/1978 Yukishita
4,175,575 A 11/1979 Cushing
4,226,490 A 10/1980 Jenkins et al.
4,301,822 A 11/1981 Dingler
4,398,562 A 8/1983 Saarem et al.
4,657,188 A 4/1987 Crane et al.
4,711,595 A 12/1987 Magid et al.
4,718,440 A 1/1988 Hawker et al.
4,732,323 A 3/1988 Jarvis et al.
4,822,241 A 4/1989 Jarvis et al.
5,098,020 A 3/1992 Cooper et al.
5,211,190 A 5/1993 Johnson et al.
5,226,454 A 7/1993 Cabalfin
5,341,827 A 8/1994 Kim
5,511,727 A 4/1996 Heren et al.
5,697,392 A 12/1997 Johnson et al.
5,725,002 A 3/1998 Payzant
5,752,533 A 5/1998 Edwards
5,759,647 A 6/1998 Kuroda et al.
5,927,616 A 7/1999 Grise et al.
6,053,185 A 4/2000 Beevers
6,431,188 B1 8/2002 Laszczewski, Jr. et al.
6,612,009 B1 9/2003 Laszczewski, Jr. et al.
6,694,990 B2 2/2004 Spanyer et al.
6,869,029 B2 3/2005 Ochoa, Sr. et al.
6,955,742 B2 10/2005 McKay et al.
7,055,537 B2 6/2006 Elick et al.
7,182,562 B2 2/2007 Botosan et al.
7,210,315 B2 5/2007 Castelli et al.
7,252,246 B2 8/2007 Heren et al.
7,258,286 B1 8/2007 Wang et al.
7,293,435 B2 11/2007 Elexpuru et al.
7,445,013 B2 11/2008 VanderRoest et al.
7,464,718 B2 12/2008 McIntyre et al.
7,556,049 B2 7/2009 Oakes et al.
7,587,916 B2 9/2009 Rizzetto
7,594,513 B2 9/2009 VanderRoest et al.
7,607,325 B2 10/2009 Elexpuru et al.
7,650,765 B2 1/2010 Rizzetto
7,914,625 B2 3/2011 Bertsch et al.
7,935,194 B2 5/2011 Rolek
7,959,744 B2 6/2011 Sundaram et al.
8,136,537 B2 3/2012 Cerrano et al.
8,161,995 B2 4/2012 Armstrong et al.
8,191,560 B2 6/2012 Mallory et al.
8,443,765 B2 5/2013 Hollis
8,696,827 B2 4/2014 Buddharaju et al.
8,778,094 B2 7/2014 Blanchard et al.
8,858,729 B2 10/2014 Büsing et al.
8,900,375 B2 12/2014 Beaudet et al.
8,915,257 B2 12/2014 Buesing
8,932,411 B2 1/2015 Pyo et al.
8,978,674 B2 3/2015 Wagner
8,985,128 B2 3/2015 Ashrafzadeh et al.
9,121,217 B1 9/2015 Hoffberg
9,170,584 B2 10/2015 Lum et al.
9,199,286 B2 12/2015 Jendrichowski et al.
9,204,780 B2 12/2015 Francisco et al.
9,220,393 B2 12/2015 Becker et al.
9,241,604 B2 1/2016 Dries
9,259,137 B2 2/2016 Boyer et al.
9,265,400 B2 2/2016 Bigott
9,307,888 B2 4/2016 Baldwin et al.
9,326,657 B2 5/2016 Thiyagarajan
9,480,389 B2 11/2016 Haft et al.
9,492,055 B2 11/2016 Feddema
9,532,700 B2 1/2017 Welch
9,635,994 B2 5/2017 Boyer et al.
9,655,496 B2 5/2017 Baldwin et al.
9,915,356 B2 3/2018 Chang et al.
9,936,850 B2 4/2018 Becker
9,958,073 B2 5/2018 Yang
10,524,634 B2 1/2020 Digman
10,531,781 B2 1/2020 Digman et al.
10,631,708 B2 4/2020 Digman et al.
10,765,291 B2 9/2020 Digman et al.
11,026,559 B2 6/2021 Boyer
11,071,440 B2 7/2021 Digman
2005/0011544 A1 1/2005 Rosenbauer et al.
2005/0139240 A1 6/2005 Bong et al.
2005/0241680 A1 11/2005 Noh
2005/0241681 A1 11/2005 Hwang
2006/0090778 A1 5/2006 Oakes et al.
2006/0278258 A1 12/2006 Kara et al.
2007/0215187 A1 9/2007 Koch
2008/0163904 A1 7/2008 Hwang
2008/0271765 A1 11/2008 Burrows
2008/0276975 A1 11/2008 Disch
2009/0071508 A1 3/2009 Sundaram et al.
2009/0090400 A1 4/2009 Burrows et al.
2009/0145468 A1 6/2009 Chericoni
2010/0043826 A1 2/2010 Bertsch et al.
2011/0186085 A1 8/2011 Chen et al.
2012/0060875 A1 3/2012 Fauth et al.
2012/0175431 A1 7/2012 Althammer et al.
2012/0291827 A1 11/2012 Buddharaju et al.
2013/0000762 A1 1/2013 Buddharaju et al.
2013/0068265 A1 3/2013 Gnadinger et al.
2013/0137621 A1 5/2013 Kessler
2013/0319483 A1 12/2013 Welch
2014/0059880 A1 3/2014 Bertsch et al.
2014/0069470 A1 3/2014 Baldwin et al.
2014/0345654 A1 11/2014 Cho et al.
2014/0373876 A1 12/2014 Feddema
2015/0007861 A1 1/2015 Azmi et al.
2015/0266065 A1 9/2015 Savoia
2016/0058264 A1 3/2016 Thiyagarajan
2016/0198928 A1 7/2016 Xu et al.
2017/0135548 A1 5/2017 Swarnkar
2017/0181599 A1 6/2017 Choi et al.
2017/0224190 A1 8/2017 Sakthivel et al.
2017/0265707 A1 9/2017 Roderick et al.
2017/0273535 A1 9/2017 Roderick et al.
2017/0354308 A1 12/2017 Choi et al.
2018/0035863 A1 2/2018 Liu et al.
2018/0084967 A1 3/2018 Ross et al.
2018/0110397 A1 4/2018 Kim et al.
2018/0132692 A1 5/2018 Dries
2018/0168425 A1 6/2018 Wilson et al.
2018/0192851 A1 7/2018 Gursoy et al.
2018/0220870 A1 8/2018 Beshears, Jr. et al.
2018/0271351 A1 9/2018 Park
2018/0333037 A1 11/2018 Roderick et al.
2018/0360293 A1 12/2018 Boyer
2019/0059688 A1 2/2019 Woo et al.
2019/0099054 A1 4/2019 Digman et al.
2019/0099056 A1 4/2019 Digman
2019/0191959 A1 6/2019 Brightbill et al.
2019/0290095 A1 9/2019 Wahlberg et al.
2019/0307308 A1 10/2019 Haegermarck
2020/0077868 A1 3/2020 Digman et al.
2020/0085277 A1 3/2020 Digman et al.
2020/0085278 A1 3/2020 Digman et al.
2020/0085279 A1 3/2020 Digman et al.
2020/0107696 A1 4/2020 Digman et al.
2020/0288940 A1 9/2020 Fawaz et al.
2021/0076900 A1 3/2021 Feddema
2021/0093151 A1 4/2021 Boyer et al.
2021/0251462 A1 8/2021 Boyer
2021/0267430 A1 9/2021 Digman et al.

(56) References Cited

U.S. PATENT DOCUMENTS

| | | | |
|---|---|---|---|
| 2022/0087500 | A1 | 3/2022 | Boyer et al. |
| 2022/0313056 | A1 | 10/2022 | Boyer et al. |

FOREIGN PATENT DOCUMENTS

| | | | |
|---|---|---|---|
| CN | 1879547 | A | 12/2006 |
| CN | 101049224 | A | 10/2007 |
| CN | 101134198 | A | 3/2008 |
| CN | 201067392 | Y | 6/2008 |
| CN | 101795613 | A | 8/2010 |
| CN | 102307508 | A | 1/2012 |
| CN | 102370450 | A | 3/2012 |
| CN | 102512128 | A | 6/2012 |
| CN | 102940476 | A | 2/2013 |
| CN | 203447254 | U | 2/2014 |
| CN | 203749364 | U | 8/2014 |
| CN | 203763025 | U | 8/2014 |
| CN | 104433985 | A | 3/2015 |
| CN | 104523208 | A | 4/2015 |
| CN | 104757921 | A | 7/2015 |
| CN | 104840165 | A | 8/2015 |
| CN | 204671085 | U | 9/2015 |
| CN | 105147218 | A | 12/2015 |
| CN | 105147220 | A | 12/2015 |
| CN | 105231971 | A | 1/2016 |
| CN | 205094364 | U | 3/2016 |
| CN | 106224508 | A | 12/2016 |
| CN | 106574786 | A | 4/2017 |
| CN | 105286746 | B | 2/2018 |
| CN | 108697298 | A | 10/2018 |
| CN | 109124522 | A | 1/2019 |
| CN | 109236874 | A | 1/2019 |
| CN | 109538865 | A | 3/2019 |
| CN | 110578787 | B | 1/2021 |
| DE | 3537184 | A1 | 4/1987 |
| DE | 20113227 | U1 | 10/2001 |
| DE | 10121083 | A1 | 10/2002 |
| DE | 10300501 | A1 | 7/2004 |
| DE | 202004013786 | U1 | 11/2004 |
| DE | 102008011743 | A1 | 9/2009 |
| DE | 202014010365 | U1 | 5/2015 |
| EP | 0368096 | A2 | 5/1990 |
| EP | 0559466 | A1 | 9/1993 |
| EP | 0679365 | A1 | 11/1995 |
| EP | 0764421 | A1 | 3/1997 |
| EP | 0786231 | A2 | 7/1997 |
| EP | 0826427 | A2 | 3/1998 |
| EP | 0864291 | A1 | 9/1998 |
| EP | 1132038 | A2 | 9/2001 |
| EP | 1136030 | A1 | 9/2001 |
| EP | 1238622 | A2 | 9/2002 |
| EP | 1252856 | A2 | 10/2002 |
| EP | 1632166 | A2 | 3/2006 |
| EP | 1758494 | A1 | 3/2007 |
| EP | 2452759 | A1 | 5/2012 |
| EP | 2636786 | A1 | 9/2013 |
| EP | 2059160 | B1 | 3/2015 |
| EP | 3222191 | A1 | 9/2017 |
| FR | 1473796 | A | 3/1967 |
| GB | 572623 | A | 10/1945 |
| GB | 2244209 | A | 11/1991 |
| JP | 2003339607 | A | 12/2003 |
| JP | 2014121353 | A | 7/2014 |
| KR | 100786069 | B1 | 12/2007 |
| KR | 200442414 | Y1 | 11/2008 |
| KR | 101173691 | B1 | 8/2012 |
| KR | 200464747 | Y1 | 1/2013 |
| WO | 2009008827 | A1 | 1/2009 |
| WO | 2016008699 | A1 | 1/2016 |
| WO | 2017022974 | A1 | 2/2017 |
| WO | 2018053635 | A1 | 3/2018 |
| WO | 2018107833 | A1 | 6/2018 |
| WO | 2018107834 | A1 | 6/2018 |
| WO | 2018107835 | A1 | 6/2018 |
| WO | 2020052211 | A1 | 3/2020 |
| WO | 2020052215 | A1 | 3/2020 |

OTHER PUBLICATIONS

Electrolux Home Products, Inc. "Dishwasher Use & Care Guide 1500 Series with Fully Electronic Control" 2003.

SCRIBD, Sears Kenmore Elite 2013 Stainless Steel Tall Tub Dishwasher Service Manual, www.scribd.com, Retrieved on Dec. 5, 2018.

EverySpec, Federal Specification: Dishwashing Machines, Single Tank and Double Tank, Commercial, www.everyspec.com, Oct. 17, 1983.

Encyclo, "Keyed Connector—Definition—Encyclo", https://www.encyclo.co.uk/meaning-of-Keyed_connectors, 2020.

International Search Report and Written Opinion issued in Application No. PCT/CN2020/108004 dated Oct. 26, 2020.

Boyan Manufacturing Solutions, Custom Plastic Helical Gears, Retrieved on Jul. 1, 2020.

Gardiner, Ginger, Injection-Forming for High-Performance, Unitized Thermoplastic Structures, CompositesWorld, Jul. 30, 2019.

International Search Report and Written Opinion issued in Application No. PCT/CN2021/110530, dated Oct. 27, 2021.

U.S. Patent and Trademark Office, Office Action issued in U.S. Appl. No. 16/795,484 dated May 18, 2022.

U.S. Patent and Trademark Office, Notice of Allowance issued in U.S. Appl. No. 16/795,484 dated Oct. 5, 2022.

U.S. Patent and Trademark Office, Office Action issued in U.S. Appl. No. 17/671,872 dated Mar. 23, 2023.

U.S. Patent and Trademark Office, Notice of Allowance issued in U.S. Appl. No. 17/027,204 dated Jul. 11, 2022.

International Search Report and Written Opinion issued in Application No. PCT/CN2021/110536 dated Oct. 26, 2021.

International Search Report and Written Opinion issued in Application No. PCT/CN2018/074294 dated Jul. 5, 2018.

International Search Report and Written Opinion issued in Application No. PCT/CN2018/074268 dated Jul. 13, 2018.

International Search Report and Written Opinion issued in Application No. PCT/CN2019/079236 dated Jun. 25, 2019.

International Search Report and Written Opinion issued in Application No. PCT/CN2019/078799 dated Jun. 26, 2019.

International Search Report and Written Opinion issued in Application No. PCT/CN2019/078612 dated Jun. 28, 2019.

European Patent Office, Communication issued in Application No. 19859390.7, 9 pages, dated Aug. 24, 2021.

U.S. Patent Office; Non-Final Office Action issued in U.S. Appl. No. 15/721,099 dated Jul. 30, 2019.

U.S. Patent and Trademark Office, Notice of Allowance issued in U.S. Appl. No. 16/132,125 dated Jun. 16, 2021.

International Search Report and Written Opinion issued in Application No. PCT/CN2019/078611 dated Jun. 5, 2019.

U.S. Patent and Trademark Office, Office Action issued in related U.S. Appl. No. 15/721,091 dated May 23, 2019.

U.S. Patent and Trademark Office, Office Action issued in related U.S. Appl. No. 15/721,091 dated Oct. 11, 2019.

U.S. Patent Office; Notice of Allowance issued in U.S. Appl. No. 15/721,091 dated Oct. 23, 2019.

U.S. Patent and Trademark Office, Office Action issued in related U.S. Appl. No. 15/721,099 dated Nov. 4, 2019.

U.S. Patent Office; Notice of Allowance issued in U.S. Appl. No. 15/721,099 dated Nov. 18, 2019.

International Search Report and Written Opinion issued in Application No. PCT/CN2019/097332 dated Dec. 9, 2019.

U.S. Patent and Trademark Office, Notice of Allowance issued in U.S. Appl. No. 16/132,091 dated Mar. 18, 2020.

U.S. Patent and Trademark Office, Office Action issued in U.S. Appl. No. 16/132,114 dated Apr. 9, 2020.

U.S. Patent and Trademark Office, Office Action issued in U.S. Appl. No. 16/132,106 dated Jul. 23, 2020.

U.S. Patent and Trademark Office, Notice of Allowance issued in U.S. Appl. No. 16/132,114 dated Jul. 27, 2020.

(56) References Cited

OTHER PUBLICATIONS

U.S. Patent and Trademark Office, Office Action issued in U.S. Appl. No. 16/298,007 dated Oct. 19, 2020.
U.S. Patent and Trademark Office, Notice of Allowance issued in U.S. Appl. No. 16/298,007 dated May 19, 2021.
U.S. Patent and Trademark Office, Final Office Action issued in U.S. Appl. No. 16/132,106 dated Jan. 7, 2021.
U.S. Patent and Trademark Office, Notice of Allowance issued in U.S. Appl. No. 16/707,181 dated May 6, 2021.
U.S. Patent and Trademark Office, Final Office Action issued in U.S. Appl. No. 16/298,007 dated Feb. 24, 2021.
U.S. Patent and Trademark Office, Advisory Action issued in U.S. Appl. No. 16/132,106 dated Mar. 26, 2021.
U.S. Patent and Trademark Office, Notice of Allowance issued in U.S. Appl. No. 16/132,106 dated Apr. 6, 2021.
U.S. Patent and Trademark Office, Office Action issued in U.S. Appl. No. 16/707,181 dated Apr. 7, 2021.

DISHWASHER WITH RACK-MOUNTED TUBULAR SPRAY ELEMENT ASSEMBLY

BACKGROUND

Dishwashers are used in many single-family and multi-family residential applications to clean dishes, silverware, cutlery, cups, glasses, pots, pans, etc. (collectively referred to herein as "utensils"). Many dishwashers rely primarily on rotatable spray arms that are disposed at the bottom and/or top of a tub and/or are mounted to a rack that holds utensils. A spray arm is coupled to a source of wash fluid and includes multiple apertures for spraying wash fluid onto utensils, and generally rotates about a central hub such that each aperture follows a circular path throughout the rotation of the spray arm. The apertures may also be angled such that force of the wash fluid exiting the spray arm causes the spray arm to rotate about the central hub.

While traditional spray arm systems are simple and mostly effective, they have the shortcoming that they must spread the wash fluid over all areas equally to achieve a satisfactory result. In doing so, resources such as time, energy and water are generally wasted because wash fluid cannot be focused precisely where it is needed. Moreover, because spray arms follow a generally circular path, the corners of a tub may not be covered as thoroughly, leading to lower cleaning performance for utensils located in the corners of a rack. In addition, in some instances the spray jets of a spray arm may be directed to the sides of a wash tub during at least portions of the rotation, leading to unneeded noise during a wash cycle.

A different approach to traditional spray arm systems utilizes one or more tubular spray elements to spray utensils within a dishwasher. A tubular spray element is a type of rotatable conduit that both conveys wash fluid along its length and ejects the wash fluid through various apertures disposed on an exterior surface thereof. A tubular spray element is generally formed of an elongated body and rotates about a longitudinal axis thereof, either in a controllable or uncontrollable fashion, e.g., based upon an electric drive, a hydraulic drive, or as a result of rotational forces imparted by the ejection of wash fluid from the tubular spray element.

Tubular spray elements may be supported on the wall of a dishwasher wash tub, or alternatively, supported by a rack in the dishwasher. When tubular spray elements are supported by a rack, accommodations generally must be made to supply wash fluid and rotate the tubular spray elements, while still enabling the rack to be moved between loading (extended) and washing (retracted) positions.

SUMMARY

The herein-described embodiments address these and other problems associated with the art by utilizing in a dishwasher a rack-mounted tubular spray element assembly capable of both rotating and supplying fluid to multiple rack-supported tubular spray elements when the rack is in a washing position that couples the rack-mounted tubular spray element assembly to a wall-supported and electrical motor-driven rotatable drive member and a wall-supported fluid port that is physically separated from the rotatable drive member.

Therefore, consistent with one aspect of the invention, a dishwasher may include a wash tub, a rack supported in the wash tub and movable between loading and washing positions, a first tubular spray element supported at a first position on the rack and being rotatable about a first longitudinal axis, the first tubular spray element including a first plurality of apertures extending through a first exterior surface of the first tubular spray element and in fluid communication with a first fluid inlet, a second tubular spray element supported at a second position on the rack and being rotatable about a second longitudinal axis, the second tubular spray element including a second plurality of apertures extending through a second exterior surface of the second tubular spray element and in fluid communication with a second fluid inlet, a rotatable drive member supported on a wall of the wash tub, an electric motor supported on the wall of the wash tub and configured to rotate the rotatable drive member, a fluid port supported on the wall of the wash tub and physically separated from the rotatable drive member, the fluid port in fluid communication with a fluid supply, and a rack-mounted tubular spray element assembly supported by the rack. The rack-mounted tubular spray element assembly may include a fluid manifold including a manifold fluid inlet in fluid communication with first and second manifold fluid outlets, the manifold fluid inlet positioned to receive fluid from the fluid port when the rack is disposed in the washing position, and the first and second manifold fluid outlets respectively in fluid communication with the first and second fluid inlets of the first and second tubular spray elements, first and second gears respectively coupled to the first and second tubular spray elements to rotate the first and second spray elements about the respective first and second longitudinal axes, and a third gear operably coupled to the first and second gears and configured to be rotated by the rotatable drive member when the rack is disposed in the washing position to thereby rotate the first and second gears.

In some embodiments, the first, second and third gears each include teeth, and the teeth of the third gear engage the teeth of the first gear and the teeth of the second gear. Also, in some embodiments, the first and second gears respectively rotate about first and second axes of rotation that are substantially coaxial with the respective first and second longitudinal axes of the first and second tubular spray elements. Further, in some embodiments, the third gear is rotatable about a third axis of rotation that is parallel to each of the first and second axes of rotation. In some embodiments, the third gear is interposed between the first and second gears and the first, second and third gears rotate in a common plane such that rotation of the third gear in a first direction about the third axis of rotation causes rotation of each of the first and second gears about the respective first and second axes of rotation in a second direction that is opposite that of the first direction.

In addition, in some embodiments, the first fluid inlet of the first tubular spray element, the first manifold fluid outlet, and the first axis of rotation are substantially coaxial with one another and the second fluid inlet of the second tubular spray element, the second manifold fluid outlet, and the second axis of rotation are substantially coaxial with one another.

In some embodiments, the rack-mounted tubular spray element assembly further includes a mounting bracket that supports the rack-mounted tubular spray element assembly on the rack, the mounting bracket including first, second and third sleeves respectively configured to rotatably support the first, second and third gears. In addition, in some embodiments, the first and second gears respectively include first and second axles projecting respectively through the first and second sleeves of the mounting bracket and first and second retaining clips respectively secured to the first and second axles to secure the first and second gears to the mounting bracket, and the first and second axles respectively include first and second channels to convey wash fluid from the first and second manifold fluid outlets to the first and second fluid inlets of the first and second tubular spray elements.

Moreover, in some embodiments, the rack-mounted tubular spray element assembly further includes first and second caps, the first cap configured to secure the first manifold fluid outlet to the first sleeve of the mounting bracket and the second cap configured to secure the second manifold fluid outlet to the second sleeve of the mounting bracket.

In some embodiments, the first and second tubular spray elements are respectively secured to the first and second axles of the first and second gears. Moreover, in some embodiments, the rotatable drive member includes a keyed shaft and the third gear includes a keyed slot that mates with the keyed shaft of the rotatable drive member when the rack is in the washing position. In some embodiments, the keyed slot is cylindrical and includes mating member that extends inwardly from an inner wall of the keyed slot along a radial direction that engages with the keyed shaft when the rotatable drive member is rotated about a rotational axis thereof.

Some embodiments may also include a motor housing supported on the wall of the wash tub and housing the electric motor. In addition, in some embodiments, the rotatable drive member projects through the motor housing and is sealed by a shaft seal. Some embodiments may also include a position sensor disposed in the motor housing and configured to detect at least one rotational position of the rotatable drive member. Moreover, in some embodiments, the position sensor includes a microswitch, and the dishwasher further includes a cam coupled to the rotatable drive member and configured to selectively engage the microswitch at the at least one rotational position of the rotatable drive member.

In addition, some embodiments may further include a fluid supply conduit extending along the wall of the wash tub, and the fluid port is disposed on the fluid supply conduit opposite the manifold fluid inlet when the rack is in the washing position. In some embodiments, the rack-mounted tubular spray element further includes a bellows circumscribing the manifold fluid inlet and configured to circumscribe the fluid port when the rack is in the washing position. In addition, in some embodiments, the fluid supply conduit is disposed on an inner surface of the wall of the wash tub and extends along a substantially vertical axis, and the fluid port is physically separated from the rotatable drive member along the substantially vertical axis. Also, in some embodiments, the manifold fluid inlet and the first and second manifold fluid outlets are arranged in a substantially U-shaped arrangement within a plane substantially parallel to the wall of the wash tub.

Other embodiments may include various methods for making and/or using any of the aforementioned constructions.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
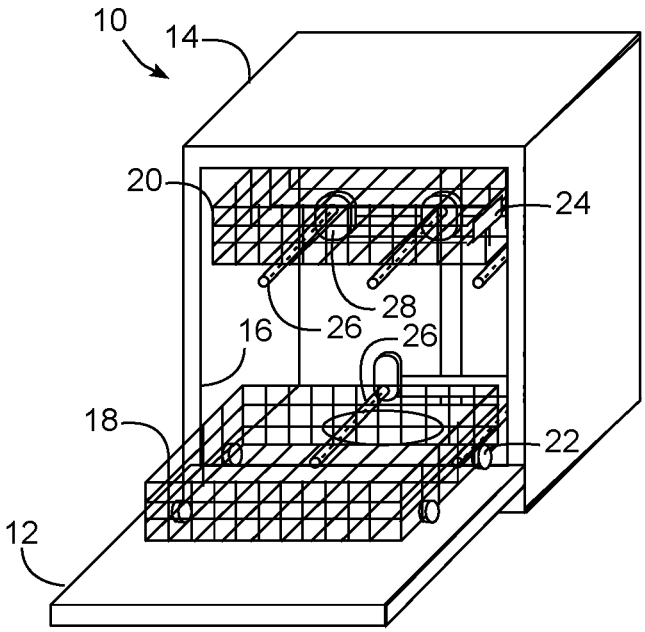
FIG. 1 is a perspective view of a dishwasher consistent with some embodiments of the invention.

In some embodiments consistent with the invention, a rack-mounted tubular spray element assembly may be used to both rotate and supply fluid to multiple rack-supported tubular spray elements when the rack is in a washing position that couples the rack-mounted tubular spray element assembly to a wall-supported and electrical motor-driven rotatable drive member and a wall-supported fluid port that is physically separated from the rotatable drive member.

A tubular spray element, in this regard, may be considered to be a type of rotatable conduit that includes a body capable of communicating a fluid such as water, a wash fluid including water, detergent and/or another treatment composition, or pressurized air, and that is capable of communicating the fluid to one or more apertures or nozzles to spray fluid onto utensils within a wash tub. A tubular spray element generally includes an elongated body, which may be generally cylindrical in some embodiments but may also have other cross-sectional profiles in other embodiments, and which has one or more apertures disposed on an exterior surface thereof and in fluid communication with a fluid supply, e.g., through one or more internal passageways defined therein. A tubular spray element also has a longitudinal axis generally defined along its longest dimension and about which the tubular spray element rotates. Further, when a tubular spray element is mounted on a rack and configured to selectively engage with a dock based upon the position of the rack, this longitudinal axis may also be considered to be an axis of insertion. A tubular spray element may also have a cross-sectional profile that varies along the longitudinal axis, so it will be appreciated that a tubular spray element need not have a circular cross-sectional profile along its length as is illustrated in a number embodiments herein. In addition, the one or more apertures on the exterior surface of a tubular spray element may be arranged into nozzles in some embodiments, and may be fixed or movable (e.g., rotating, oscillating, etc.) with respect to other apertures on the tubular spray element. Further, the exterior surface of a tubular spray element may be defined on multiple components of a tubular spray element, i.e., the exterior surface need not be formed by a single integral component.

In addition, in some embodiments a tubular spray element may be discretely directed by a tubular spray element drive to multiple rotational positions about the longitudinal axis to spray a fluid in predetermined directions into a wash tub of a dishwasher during a wash cycle. In some embodiments, the tubular spray element may be operably coupled to such a drive through a support arrangement that both rotates the tubular spray element and supplies fluid to the tubular spray element, as will become more apparent below. Further details regarding tubular spray elements may be found, for example, in U.S. Pat. No. 10,531,781 to Digman et al., which is assigned to the same assignee as that of the present application, and which is incorporated by reference herein. In other embodiments, however, a tubular spray element may rotate in a less controlled fashion, e.g., through the use of an electric drive, a hydraulic drive, or based upon a force generated in reaction to the ejection of wash fluid from the tubular spray element itself. In such instances, the rotational position of a tubular spray element may not be discretely controlled and/or known at any given time, although other aspects of the rotation or operation of the tubular spray element may still be controlled in some embodiments, e.g., the speed of rotation, whether rotation is enabled or disabled, and/or whether fluid flow is provided to the tubular spray element, etc.

Dishwasher

Turning now to the drawings, wherein like numbers denote like parts throughout the several views, FIG. 1 illustrates an example dishwasher 10 in which the various technologies and techniques described herein may be implemented. Dishwasher 10 is a residential-type built-in dishwasher, and as such includes a front-mounted door 12 that provides access to a wash tub 16 housed within the cabinet or housing 14. Door 12 is generally hinged along a bottom edge and is pivotable between the opened position illustrated in FIG. 1 and a closed position (not shown). When door 12 is in the opened position, access is provided to one or more sliding racks, e.g., lower rack 18 and upper rack 20, within which various utensils are placed for washing. Lower rack 18 may be supported on rollers 22, while upper rack 20 may be supported on side rails 24, and each rack is movable between loading (extended) and washing (retracted) positions along a substantially horizontal direction. Control over dishwasher 10 by a user is generally managed through a control panel (not shown in FIG. 1) typically disposed on a top or front of door 12, and it will be appreciated that in different dishwasher designs, the control panel may include various types of input and/or output devices, including various knobs, buttons, lights, switches, textual and/or graphical displays, touch screens, etc. through which a user may configure one or more settings and start and stop a wash cycle.

In addition, consistent with some embodiments of the invention, dishwasher 10 may include one or more tubular spray elements (TSEs) 26 to direct a wash fluid onto utensils disposed in racks 18, 20. As will become more apparent below, tubular spray elements 26 are rotatable about respective longitudinal axes and are discretely directable by one or more tubular spray element drives (not shown in FIG. 1) to control a direction at which fluid is sprayed by each of the tubular spray elements. In some embodiments, fluid may be dispensed solely through tubular spray elements, however the invention is not so limited. For example, in some embodiments various upper and/or lower rotating spray arms may also be provided to direct additional fluid onto utensils. Still other sprayers, including various combinations of wall-mounted sprayers, rack-mounted sprayers, oscillating sprayers, fixed sprayers, rotating sprayers, focused sprayers, etc., may also be combined with one or more tubular spray elements in some embodiments of the invention.

Some tubular spray elements 26 may be fixedly mounted to a wall or other structure in wash tub 16, e.g., as may be the case for tubular spray elements 26 disposed below or adjacent lower rack 18. For other tubular spray elements 26, e.g., rack-mounted tubular spray elements, the tubular spray elements may be removably coupled to a docking arrangement such as docking arrangement 28 mounted to the rear wall of wash tub 16 in FIG. 1.

The embodiments discussed hereinafter will focus on the implementation of the hereinafter-described techniques within a hinged-door dishwasher. However, it will be appreciated that the herein-described techniques may also be used in connection with other types of dishwashers in some embodiments. For example, the herein-described techniques may be used in commercial applications in some embodiments. Moreover, at least some of the herein-described techniques may be used in connection with other dishwasher configurations, including dishwashers utilizing sliding drawers or dish sink dishwashers, e.g., a dishwasher integrated into a sink.

Figure 2:
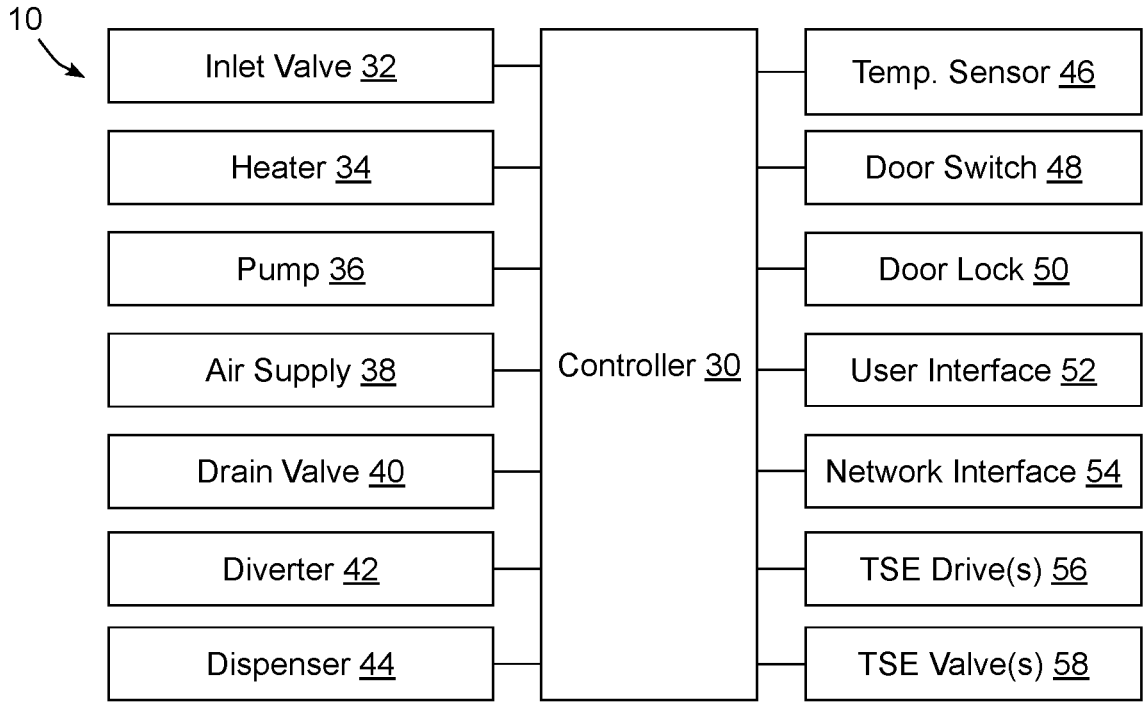
FIG. 2 is a block diagram of an example control system for the dishwasher of FIG. 1.

Now turning to FIG. 2, dishwasher 10 may be under the control of a controller 30 that receives inputs from a number of components and drives a number of components in response thereto. Controller 30 may, for example, include one or more processors and a memory (not shown) within which may be stored program code for execution by the one or more processors. The memory may be embedded in controller 30, but may also be considered to include volatile and/or non-volatile memories, cache memories, flash memories, programmable read-only memories, read-only memories, etc., as well as memory storage physically located elsewhere from controller 30, e.g., in a mass storage device or on a remote computer interfaced with controller 30.

As shown in FIG. 2, controller 30 may be interfaced with various components, including an inlet valve 32 that is coupled to a water source to introduce water into wash tub 16, which when combined with detergent, rinse agent and/or other additives, forms various wash fluids. Controller may also be coupled to a heater 34 that heats fluids, a pump 36 that recirculates wash fluid within the wash tub by pumping fluid to the wash arms and other spray devices in the dishwasher, an air supply 38 that provides a source of pressurized air for use in drying utensils in the dishwasher, a drain valve 40 that is coupled to a drain to direct fluids out of the dishwasher, and a diverter 42 that controls the routing of pumped fluid to different tubular spray elements, spray arms and/or other sprayers during a wash cycle. In some embodiments, a single pump 36 may be used, and drain valve 40 may be configured to direct pumped fluid either to a drain or to the diverter 42 such that pump 36 is used both to drain fluid from the dishwasher and to recirculate fluid throughout the dishwasher during a wash cycle. In other embodiments, separate pumps may be used for draining the dishwasher and recirculating fluid. Diverter 42 in some embodiments may be a passive diverter that automatically sequences between different outlets, while in some embodiments diverter 42 may be a powered diverter that is controllable to route fluid to specific outlets on demand. In still other embodiments, and as will be discussed in greater detail below, each tubular spray element may be separately controlled such that no separate diverter is used. Air supply 38 may be implemented as an air pump or fan in different embodiments, and may include a heater and/or other air conditioning device to control the temperature and/or humidity of the pressurized air output by the air supply.

In the illustrated embodiment, pump 36 and air supply 38 collectively implement a fluid supply for dishwasher 100, providing both a source of wash fluid and pressurized air for use respectively during wash and drying operations of a wash cycle. A wash fluid may be considered to be a fluid, generally a liquid, incorporating at least water, and in some instances, additional components such as detergent, rinse aid, and other additives. During a rinse operation, for example, the wash fluid may include only water. A wash fluid may also include steam in some instances. Pressurized air is generally used in drying operations, and may or may not be heated and/or dehumidified prior to spraying into a wash tub. It will be appreciated, however, that pressurized air may not be used for drying purposes in some embodiments, so air supply 38 may be omitted in some instances. Moreover, in some instances, tubular spray elements may be used solely for spraying wash fluid or spraying pressurized air, with other sprayers or spray arms used for other purposes, so the invention is not limited to the use of tubular spray elements for spraying both wash fluid and pressurized air.

Controller 30 may also be coupled to a dispenser 44 to trigger the dispensing of detergent and/or rinse agent into the wash tub at appropriate points during a wash cycle. Additional sensors and actuators may also be used in some embodiments, including a temperature sensor 46 to determine a wash fluid temperature, a door switch 48 to determine when door 12 is latched, and a door lock 50 to prevent the door from being opened during a wash cycle. Moreover, controller 30 may be coupled to a user interface 52 including various input/output devices such as knobs, dials, sliders, switches, buttons, lights, textual and/or graphics displays, touch screen displays, speakers, image capture devices, microphones, etc. for receiving input from and communicating with a user. In some embodiments, controller 30 may also be coupled to one or more network interfaces 54, e.g., for interfacing with external devices via wired and/or wireless networks such as Ethernet, Bluetooth, NFC, cellular and other suitable networks. Additional components may also be interfaced with controller 30, as will be appreciated by those of ordinary skill having the benefit of the instant disclosure. For example, one or more tubular spray element (TSE) drives 56 and/or one or more tubular spray element (TSE) valves 58 may be provided in some embodiments to discretely control one or more tubular spray elements disposed in dishwasher 10, as will be discussed in greater detail below.

It will be appreciated that each tubular spray element drive 56 may also provide feedback to controller 30 in some embodiments, e.g., a current position and/or speed, although in other embodiments a separate position sensor may be used. In addition, as will become more apparent below, flow regulation to a tubular spray element may be performed without the use of a separately-controlled tubular spray element valve 58 in some embodiments, e.g., where rotation of a tubular spray element by a tubular spray element drive is used to actuate a mechanical valve.

Moreover, in some embodiments, at least a portion of controller 30 may be implemented externally from a dishwasher, e.g., within a mobile device, a cloud computing environment, etc., such that at least a portion of the functionality described herein is implemented within the portion of the controller that is externally implemented. In some embodiments, controller 30 may operate under the control of an operating system and may execute or otherwise rely upon various computer software applications, components, programs, objects, modules, data structures, etc. In addition, controller 30 may also incorporate hardware logic to implement some or all of the functionality disclosed herein. Further, in some embodiments, the sequences of operations performed by controller 30 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Numerous variations and modifications to the dishwasher illustrated in FIGS. 1-2 will be apparent to one of ordinary skill in the art, as will become apparent from the description below. Therefore, the invention is not limited to the specific implementations discussed herein.

Tubular Spray Elements

Figure 3:
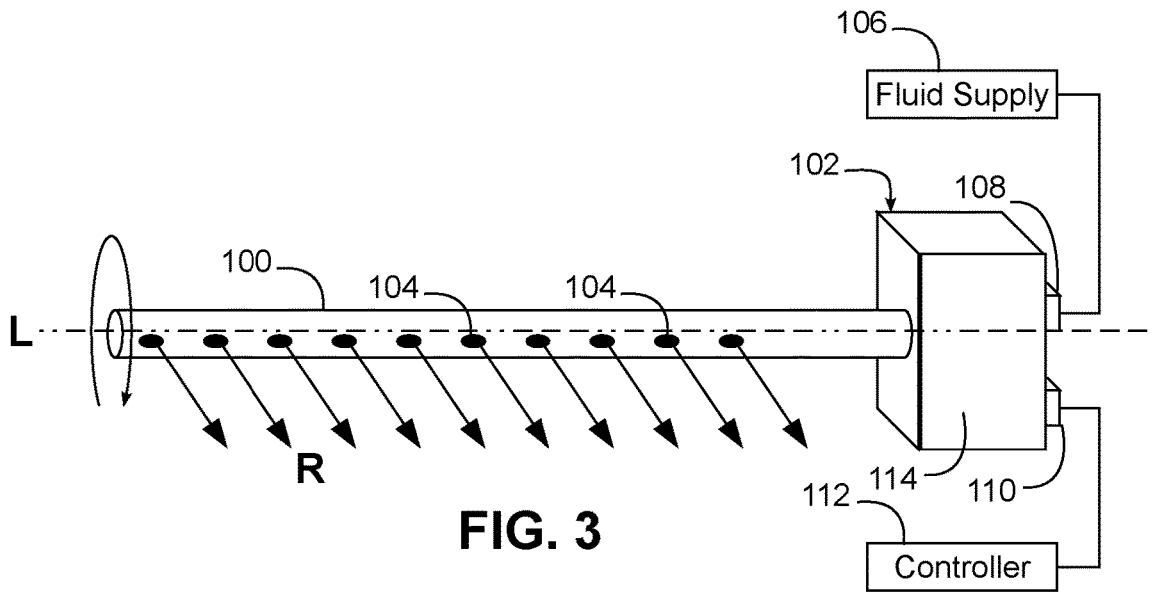
FIG. 3 is a side perspective view of a tubular spray element and tubular spray element drive from the dishwasher of FIG. 1.

Now turning to FIG. 3, in some embodiments, a dishwasher may include one or more discretely directable tubular spray elements, e.g., tubular spray element 100 coupled to a tubular spray element drive 102. Tubular spray element 100 may be configured as a tube or other elongated body disposed in a wash tub and being rotatable about a longitudinal axis L. In addition, tubular spray element 100 is generally hollow or at least includes one or more internal fluid passages that are in fluid communication with one or more apertures 104 extending through an exterior surface thereof. Each aperture 104 may function to direct a spray of fluid into the wash tub, and each aperture may be configured in various manners to provide various types of spray patterns, e.g., streams, fan sprays, concentrated sprays, etc. Apertures 104 may also in some instances be configured as fluidic nozzles providing oscillating spray patterns.

Moreover, as illustrated in FIG. 3, apertures 104 may all be positioned to direct fluid along a same radial direction from axis L, thereby focusing all fluid spray in generally the same radial direction represented by arrows R. In other embodiments, however, apertures may be arranged differently about the exterior surface of a tubular spray element, e.g., to provide spray from two, three or more radial directions, to distribute a spray over one or more arcs about the circumference of the tubular spray element, etc.

Tubular spray element 100 is in fluid communication with a fluid supply 106, e.g., through a port 108 of tubular spray element drive 102, to direct fluid from the fluid supply into the wash tub through the one or more apertures 104. Tubular spray element drive 102 is coupled to tubular spray element 100 and is configured to discretely direct the tubular spray element 100 to each of a plurality of rotational positions about longitudinal axis L. By "discretely directing," what is meant is that tubular spray element drive 102 is capable of rotating tubular spray element 100 generally to a controlled rotational angle (or at least within a range of rotational angles) about longitudinal axis L. Thus, rather than uncontrollably rotating tubular spray element 100 or uncontrollably oscillating the tubular spray element between two fixed rotational positions, tubular spray element drive 102 is capable of intelligently focusing the spray from tubular spray element 100 between multiple rotational positions. It will also be appreciated that rotating a tubular spray element to a controlled rotational angle may refer to an absolute rotational angle (e.g., about 10 degrees from a home position) or may refer to a relative rotational angle (e.g., about 10 degrees from the current position).

Tubular spray element drive 102 is also illustrated with an electrical connection 110 for coupling to a controller 112, and a housing 114 is illustrated for housing various components in tubular spray element drive 102 that will be discussed in greater detail below. In the illustrated embodiment, tubular spray element drive 102 is configured as a base that supports, through a rotary coupling, an end of the tubular spray element and effectively places the tubular spray element in fluid communication with port 108.

By having an intelligent control provided by tubular spray element drive 102 and/or controller 112, spray patterns and cycle parameters may be increased and optimized for different situations. For instance, tubular spray elements near the center of a wash tub may be configured to rotate 360 degrees, while tubular spray elements located near wash tub walls may be limited to about 180 degrees of rotation to avoid spraying directly onto any of the walls of the wash tub, which can be a significant source of noise in a dishwasher. In another instance, it may be desirable to direct or focus a tubular spray element to a fixed rotational position or over a small range of rotational positions (e.g., about 5-10 degrees) to provide concentrated spray of liquid, steam and/or air, e.g., for cleaning silverware or baked on debris in a pan. In addition, in some instances the rotational velocity of a tubular spray element could be varied throughout rotation to provide longer durations in certain ranges of rotational positions and thus provide more concentrated washing in particular areas of a wash tub, while still maintaining rotation through 360 degrees. Control over a tubular spray element may include control over rotational position, speed or rate of rotation and/or direction of rotation in different embodiments of the invention.

Figure 4:
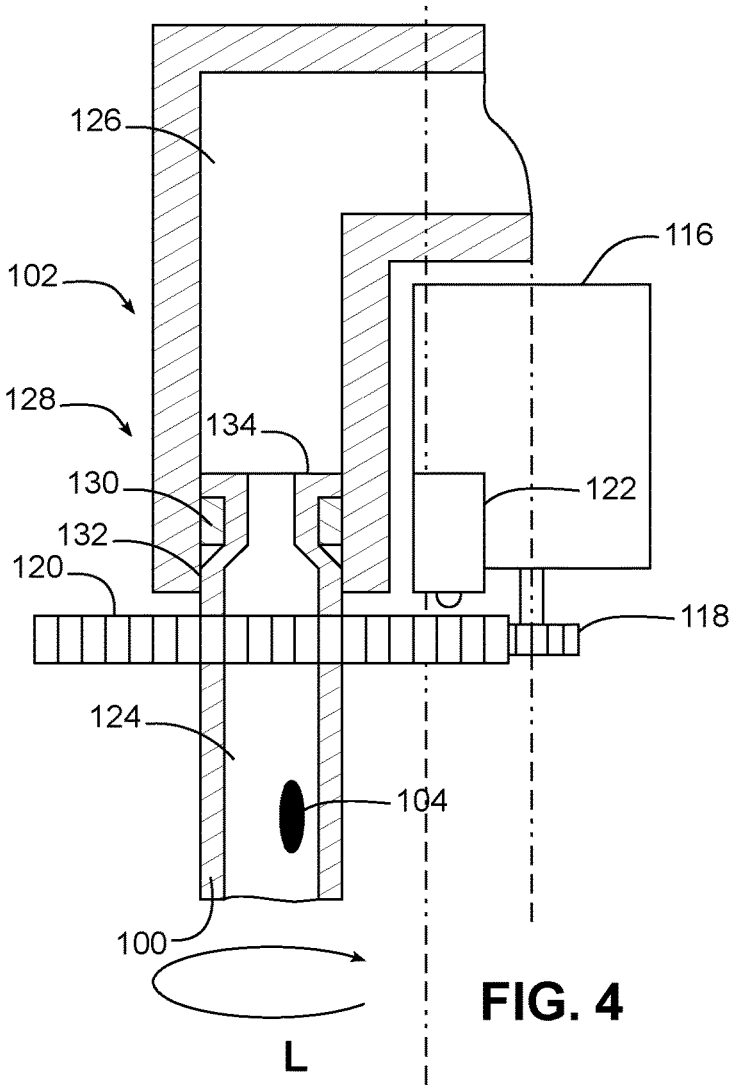
FIG. 4 is a partial cross-sectional view of the tubular spray element and tubular spray element drive of FIG. 3.

FIG. 4 illustrates one example implementation of tubular spray element 100 and tubular spray element drive 102 in greater detail, with housing 114 omitted for clarity. In this implementation, tubular spray element drive 102 includes an electric motor 116, which may be an alternating current (AC) or direct current (DC) motor, e.g., a brushless DC motor, a stepper motor, etc., which is mechanically coupled to tubular spray element 100 through a gearbox including a pair of gears 118, 120 respectively coupled to motor 116 and tubular spray element 100. Other manners of mechanically coupling motor 116 to tubular spray element 100 may be used in other embodiments, e.g., different numbers and/or types of gears, belt and pulley drives, magnetic drives, hydraulic drives, linkages, friction, etc.

In addition, an optional position sensor 122 may be disposed in tubular spray element drive 102 to determine a rotational position of tubular spray element 100 about axis L. Position sensor 122 may be an encoder or hall sensor in some embodiments, or may be implemented in other manners, e.g., integrated into a stepper motor, whereby the rotational position of the motor is used to determine the rotational position of the tubular spray element. Position sensor 122 may also sense only limited rotational positions about axis L (e.g., a home position, 30 or 45 degree increments, etc.). Further, in some embodiments, rotational position may be controlled using time and programming logic, e.g., relative to a home position, and in some instances without feedback from a motor or position sensor. Position sensor 122 may also be external to tubular spray element drive 102 in some embodiments.

An internal passage 124 in tubular spray element 100 is in fluid communication with an internal passage 126 leading to port 108 (not shown in FIG. 4) in tubular spray element drive 102 through a rotary coupling 128. In one example implementation, coupling 128 is formed by a bearing 130 mounted in passageway 126, with one or more deformable tabs 134 disposed at the end of tubular spray element 100 to secure tubular spray element 100 to tubular spray element drive 102. A seal 132, e.g., a lip seal, may also be formed between tubular spray element 100 and tubular spray element drive 102. Other manners of rotatably coupling the tubular spray element while providing fluid flow may be used in other embodiments.

Figure 5:
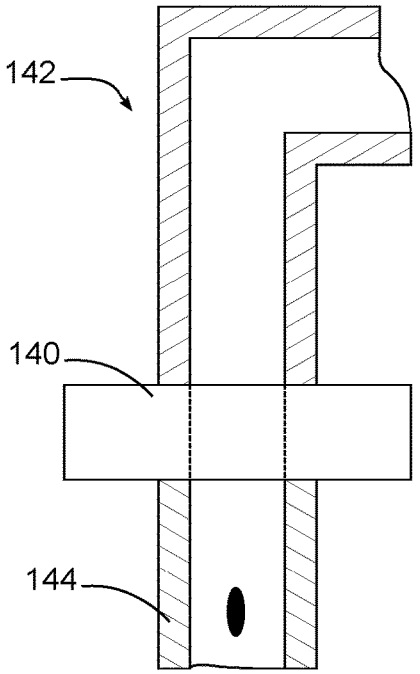
FIG. 5 is a partial cross-sectional view of another tubular spray element and tubular spray element drive consistent with some embodiments of the invention, and including a valve for restricting flow to the tubular spray element.

Turning to FIG. 5, it also may be desirable in some embodiments to incorporate a valve 140 into a tubular spray element drive 142 to regulate the fluid flow to a tubular spray element 144 (other elements of drive 142 have been omitted from FIG. 5 for clarity). Valve 140 may be an on/off valve in some embodiments or may be a variable valve to control flow rate in other embodiments. In still other embodiments, a valve may be external to or otherwise separate from a tubular spray element drive, and may either be dedicated to the tubular spray element or used to control multiple tubular spray elements. Valve 140 may be integrated with or otherwise proximate a rotary coupling between tubular spray element 144 and tubular spray element drive 142. By regulating fluid flow to tubular spray elements, e.g., by selectively shutting off tubular spray elements, water can be conserved and/or high-pressure zones can be created by pushing all of the hydraulic power through fewer numbers of tubular spray elements.

In some embodiments, valve 140 may be actuated independent of rotation of tubular spray element 144, e.g., using an iris valve, butterfly valve, gate valve, plunger valve, piston valve, valve with a rotatable disc, ball valve, etc., and actuated by a solenoid, motor or other separate mechanism from the mechanism that rotates tubular spray element 144. In other embodiments, however, valve 140 may be actuated through rotation of tubular spray element 144. In some embodiments, for example, rotation of tubular spray element 144 to a predetermined rotational position may close valve 140, e.g., where valve 140 includes an arcuate channel that permits fluid flow over only a range of rotational positions. In other embodiments, a valve may be actuated through over-rotation of a tubular spray element, or through counter rotation of a tubular spray element. Further, in some embodiments, a valve may be variable, e.g., configured as an iris valve, to regulate fluid flow to the tubular spray element, and may be independently actuated from rotation of a tubular spray element in some embodiments (e.g., via a solenoid or motor), or may be actuated through rotation of a tubular spray element, e.g., through rotation to a predetermined position, an over-rotation, or a counter-rotation, using appropriate mechanical linkages. Other variations will be appreciated by those of ordinary skill having the benefit of the instant disclosure.

Figure 6:
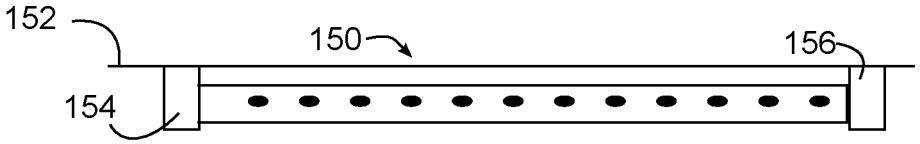
FIG. 6 is a functional top plan view of an example implementation of a wall-mounted tubular spray element and tubular spray element drive consistent with some embodiments of the invention.
Figure 7:
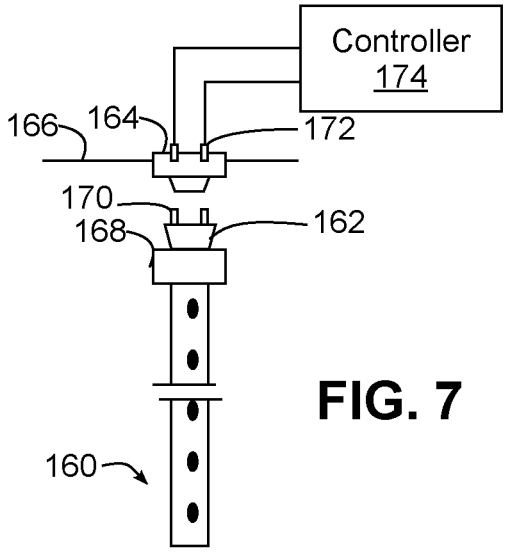
FIG. 7 is a functional top plan view of an example implementation of a rack-mounted tubular spray element and tubular spray element drive consistent with some embodiments of the invention.
Figure 8:
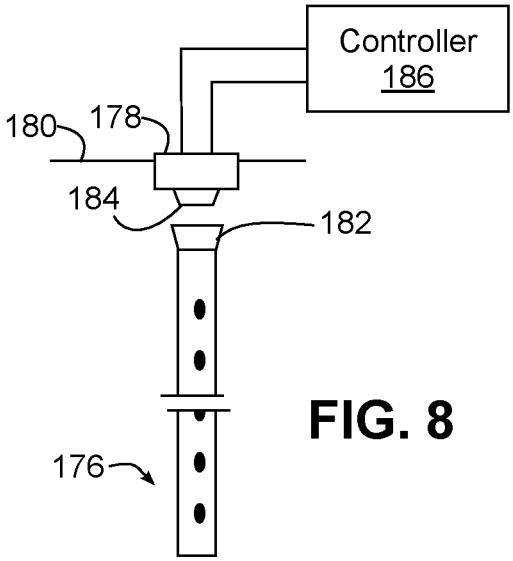
FIG. 8 is a functional top plan view of another example implementation of a rack-mounted tubular spray element and tubular spray element drive consistent with some embodiments of the invention.

Now turning to FIGS. 6-8, tubular spray elements may be mounted within a wash tub in various manners in different embodiments. As illustrated by FIGS. 1 and 3 (discussed above), a tubular spray element in some embodiments may be mounted to a wall (e.g., a side wall, a back wall, a top wall, a bottom wall, or a door) of a wash tub, and may be oriented in various directions, e.g., horizontally, vertically, front-to-back, side-to-side, or at an angle. It will also be appreciated that a tubular spray element drive may be disposed within a wash tub, e.g., mounted on wall of the wash tub or on a rack or other supporting structure, or alternatively some or all of the tubular spray element drive may be disposed external from a wash tub, e.g., such that a portion of the tubular spray element drive or the tubular spray element projects through an aperture in the wash tub. Alternatively, a magnetic drive could be used to drive a tubular spray element in the wash tub using an externally-mounted tubular spray element drive.

Moreover, as illustrated by tubular spray element 150 of FIG. 6, rather than being mounted in a cantilevered fashion as is the case with tubular spray element 100 of FIG. 3, a tubular spray element may also be mounted on a wall 152 of a wash tub and supported at both ends by hubs 154, 156, one or both of which may include the components of the tubular spray element drive. In this regard, the tubular spray element 150 runs generally parallel to wall 152 rather than running generally perpendicular thereto, as is the case with tubular spray element 100 of FIG. 3.

In still other embodiments, a tubular spray element may be rack-mounted. FIG. 7, for example, illustrates a tubular spray element 160 mountable on rack (not shown) and dockable via a dock 162 to a docking port 164 on a wall 166 of a wash tub. In this embodiment, a tubular spray element drive 168 is also rack-mounted, and as such, in addition to a fluid coupling between dock 162 and docking port 164, a plurality of cooperative contacts 170, 172 are provided on dock 162 and docking port 164 to provide power to tubular spray element drive 168 as well as electrical communication with a controller 174.

As an alternative, and as illustrated in FIG. 8, a tubular spray element 176 may be rack-mounted, but separate from a tubular spray element drive 178 that is not rack-mounted, but is instead mounted to a wall 180 of a wash tub. A dock 182 and docking port 184 provide fluid communication with tubular spray element 176, along with a capability to rotate tubular spray element 176 about its longitudinal axis under the control of tubular spray element drive 178. Control over tubular spray element drive 178 is provided by a controller 186. In some instances, tubular spray element drive 178 may include a rotatable and keyed channel into which an end of a tubular spray element may be received.

Figure 9:
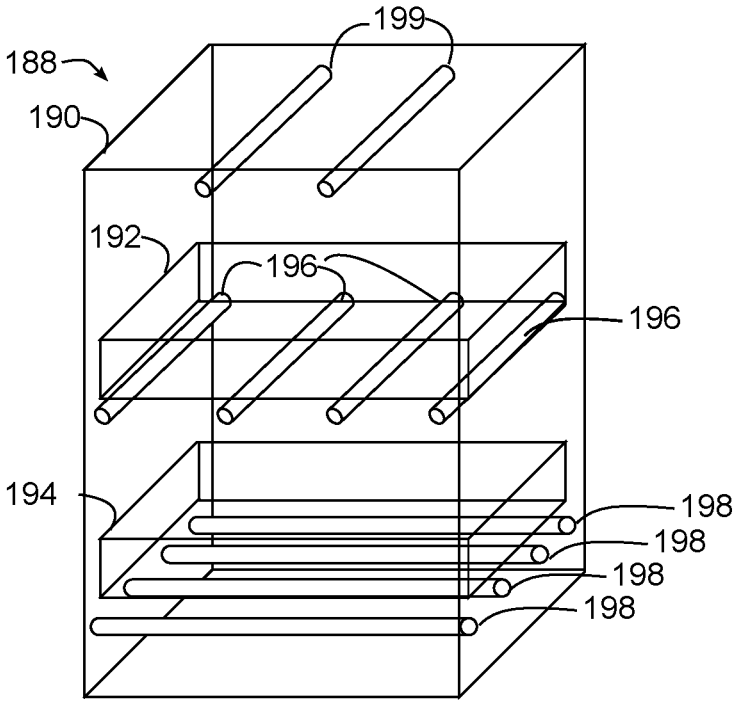
FIG. 9 is a functional perspective view of a dishwasher incorporating multiple tubular spray elements and consistent with some embodiments of the invention.

FIG. 9 next illustrates a dishwasher 188 including a wash tub 190 and upper and lower racks 192, 194, and with a number of tubular spray elements 196, 198, 199 distributed throughout the wash tub 190 for circulating a wash fluid through the dishwasher. Tubular spray elements 196 may be rack-mounted, supported on the underside of upper rack 192, and extending back-to-front within wash tub 190. Tubular spray elements 196 may also dock with back wall-mounted tubular spray element drives (not shown in FIG. 9), e.g., as discussed above in connection with FIG. 8. In addition, tubular spray elements 196 may be rotatably supported at one or more points along their respective longitudinal axes by couplings (not shown) suspended from upper rack 192. Tubular spray elements 196 may therefore spray upwardly into upper rack 192 and/or downwardly onto lower rack 194, and in some embodiments, may be used to focus wash fluid onto a silverware basket or other region of either rack to provide for concentrated washing. Tubular spray elements 198 may be wall-mounted beneath lower rack 194, and may be supported at both ends on the side walls of wash tub 190 to extend in a side-to-side fashion, and generally transverse to tubular spray elements 196. Each tubular spray element 196, 198 may have a separate tubular spray element drive in some embodiments, while in other embodiments some or all of the tubular spray elements 196, 198 may be mechanically linked and driven by common tubular spray element drives.

In some embodiments, tubular spray elements 196, 198 by themselves may provide sufficient washing action and coverage. In other embodiments, however, additional tubular spray elements, e.g., tubular spray elements 199 supported above upper rack 192 on one or both of the top and back walls of wash tub 190, may also be used. In addition, in some embodiments, additional spray arms and/or other sprayers may be used. It will also be appreciated that while 10 tubular spray elements are illustrated in FIG. 9, greater or fewer numbers of tubular spray elements may be used in other embodiments.

It will also be appreciated that in some embodiments, multiple tubular spray elements may be driven by the same tubular spray element drive, e.g., using geared arrangements, belt drives, or other mechanical couplings. Further, tubular spray elements may also be movable in various directions in addition to rotating about their longitudinal axes, e.g., to move transversely to a longitudinally axis, to rotate about an axis of rotation that is transverse to a longitudinal axis, etc. In addition, deflectors may be used in combination with tubular spray elements in some embodiments to further the spread of fluid and/or prevent fluid from hitting tub walls. In some embodiments, deflectors may be integrated into a rack, while in other embodiments, deflectors may be mounted to a wall of the wash tub. In addition, deflectors may also be movable in some embodiments, e.g., to redirect fluid between multiple directions. Moreover, while in some embodiments tubular spray elements may be used solely to spray wash fluid, in other embodiments tubular spray elements may be used to spray pressurized air at utensils during a drying operation of a wash cycle, e.g., to blow off water that pools on cups and dishes after rinsing is complete. In some instances, different tubular spray elements may be used to spray wash fluid and spray pressurized air, while in other instances the same tubular spray elements may be used to alternately or concurrently spray wash liquid and pressurized air.

Rack-Mounted Tubular Spray Element Assembly

As noted above, in some embodiments, it may be desirable to support one or more tubular spray elements on a rack of a dishwasher, such that the tubular spray elements are supported by and move with a rack as it moves between washing and loading positions. It will be appreciated, however, that it may present a challenge to control rotation of such tubular spray elements, as well as supply wash fluid to such tubular spray elements, within a dishwasher environment. Embodiments consistent with the invention, however, employ a rack-mounted tubular spray element assembly capable of both rotating and supplying fluid to multiple rack-supported tubular spray elements when a rack is in a washing position that couples the rack-mounted tubular spray element assembly to a wall-supported and electrical motor-driven rotatable drive member and a wall-supported fluid port that is physically separated from the rotatable drive member.

Figure 10:
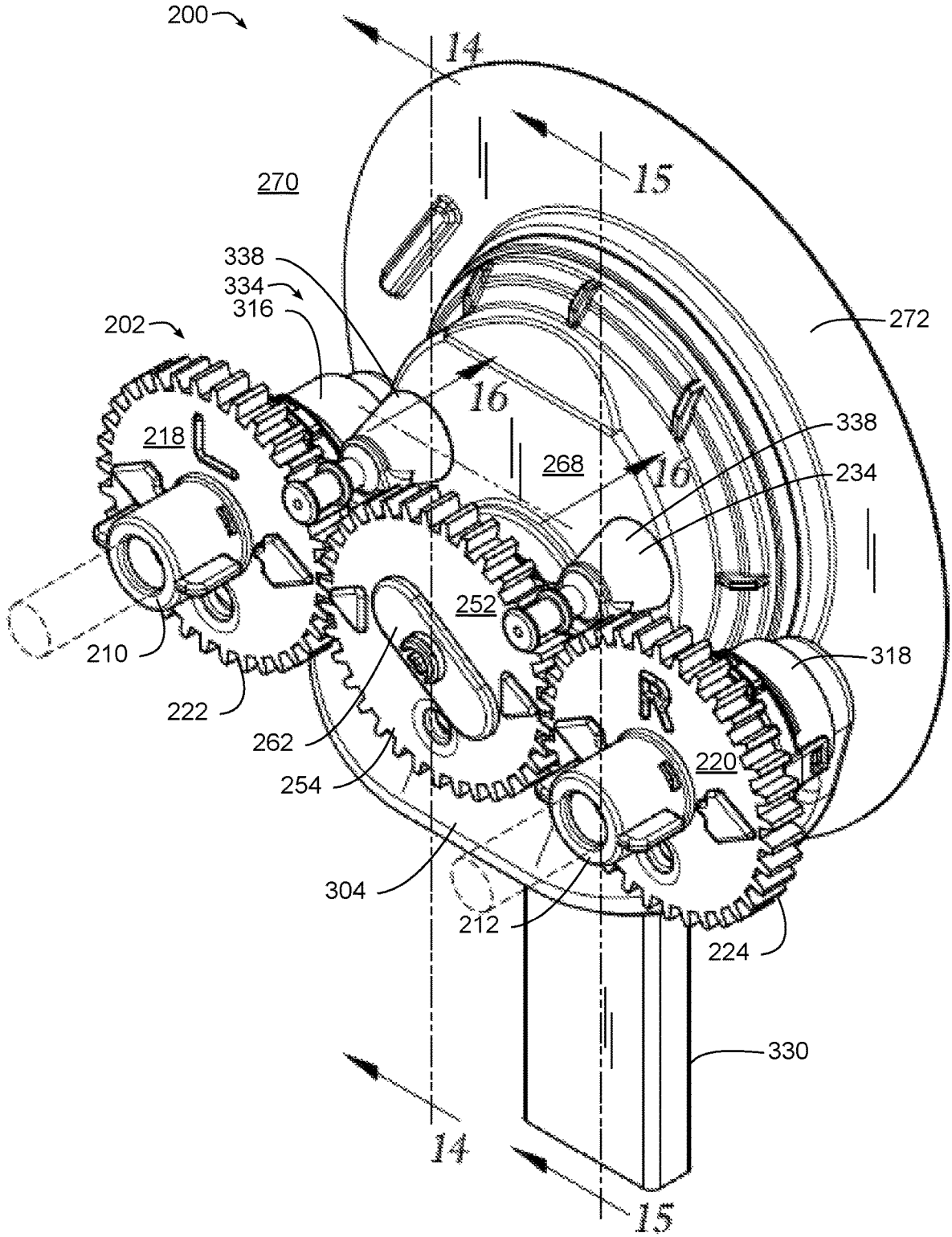
FIG. 10 is a front perspective view of an example implementation of rack-mounted tubular spray element spraying system consistent with some embodiments of the invention, when a dishwasher rack is disposed in a washing position.
Figure 11:
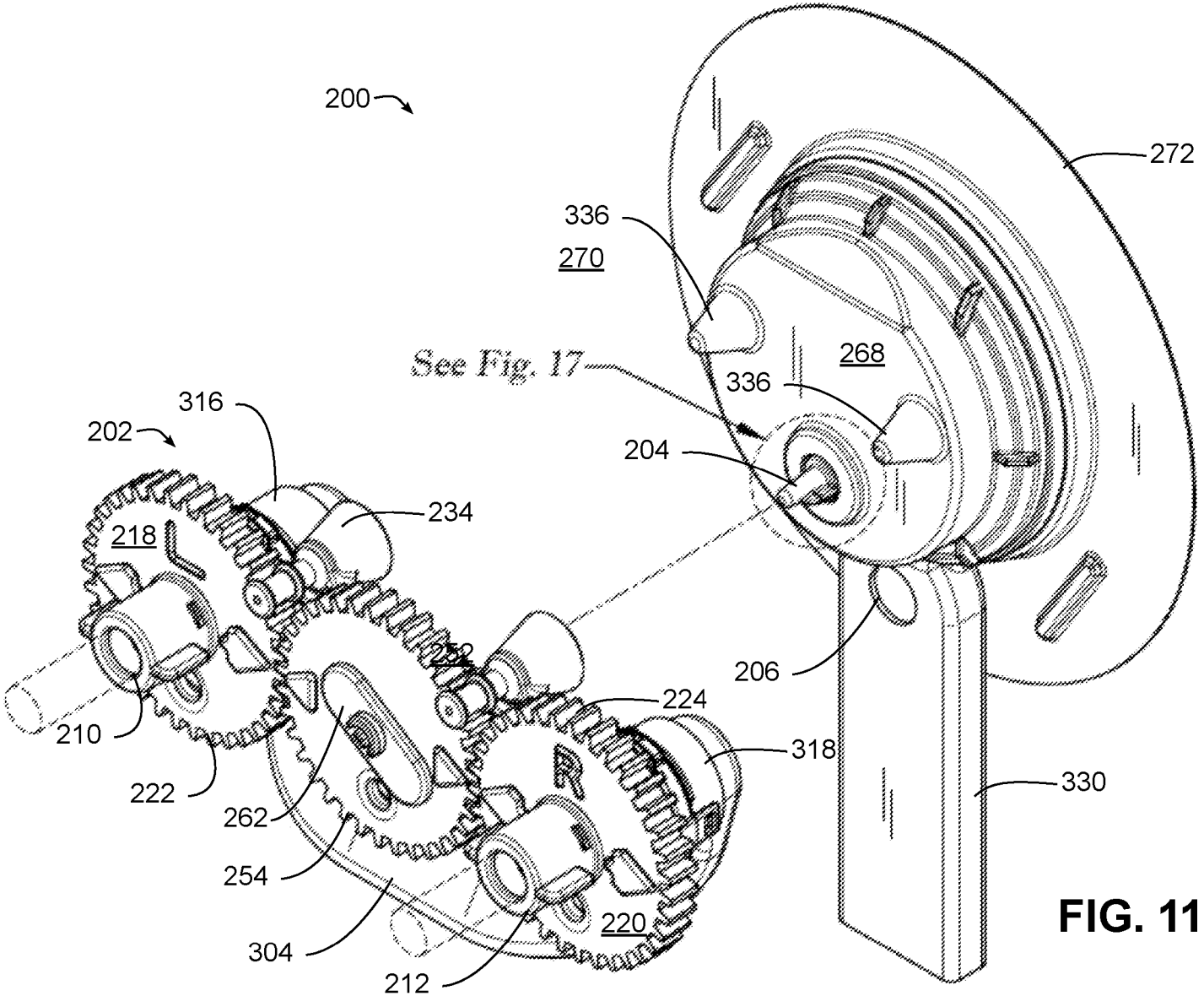
FIG. 11 is a front perspective view of the rack-mounted tubular spray element spraying system of FIG. 10, after the rack is moved away from the washing position.

FIGS. 10-17, for example, illustrate an example implementation of a rack-mounted tubular spray element spraying system 200 including a rack-mounted tubular spray element assembly 202 that interfaces with a wall-supported and electrical-motor driven rotatable drive member 204 and wall-supported fluid port 206 (e.g., as illustrated in FIG. 11) when a rack 208 (a portion of which illustrated in phantom in FIG. 14) is in a washing position.

Multiple, e.g., two, tubular spray elements 210, 212, which are truncated in FIGS. 10-16 to simplify the figures (and with metal tubes illustrated in phantom in FIGS. 10 and 11), are supported by rack-mounted tubular spray element assembly 202 at two laterally-separated positions, and extend along and rotate about respective longitudinal axes $A_1$ and $A_2$ (FIG. 12) Each tubular spray element 210, 212 includes a plurality of apertures in an exterior surface thereof (not shown in FIGS. 10-16) that are in fluid communication with a respective fluid inlet 214, 216.

Figure 12:
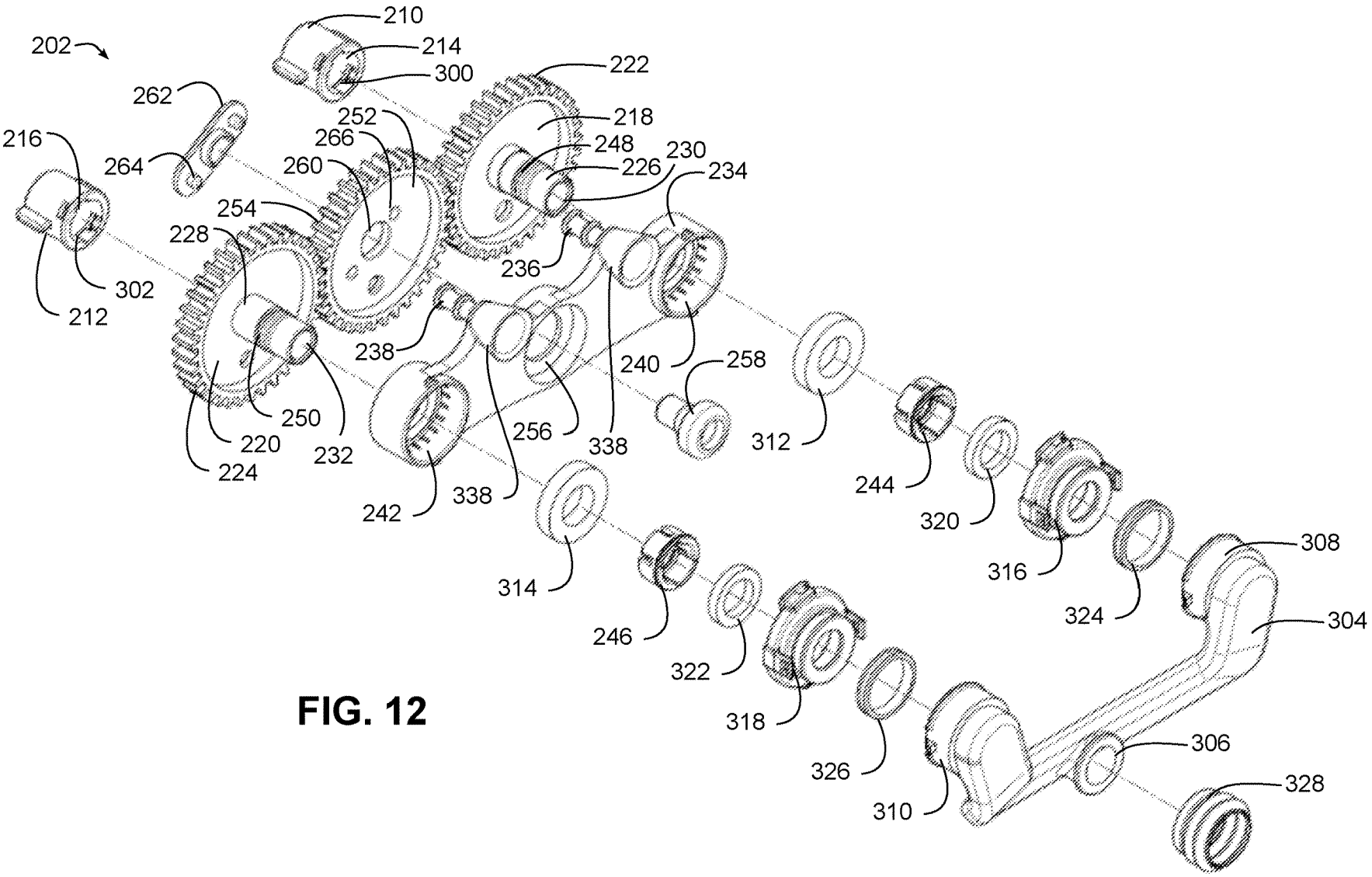
FIG. 12 is an exploded rear perspective view of the rack-mounted tubular spray element assembly of FIG. 10.

With specific reference to FIG. 12, each tubular spray element 210, 212 is operably coupled to a respective gear 218, 220 that is configured to rotate the tubular spray element 210, 212 about its respective longitudinal axis $A_1$, $A_2$. Each gear 218, 220 includes a plurality of teeth 222, 224 and an axle 226, 228 about which each gear 218, 220 rotates, and each axle 226, 228 includes a respective channel 230, 232 through which wash fluid may be supplied to each tubular spray element 210, 212.

A mounting bracket 234 supports rack-mounted tubular spray element assembly 202 on rack 208, e.g., using a pair of pins 236, 238 that engage corresponding receivers (not shown) on rack 208. Mounting bracket 234 includes a pair of sleeves 240, 242 that receive axles 226, 228 of gears 218, 220, and a pair of retaining clips 244, 246 engage annular channels 248, 250 on axles 226, 228 to retain each gear 218, 220, and thus each tubular spray element 210, 212, on mounting bracket 234.

A drive gear 252 is operably coupled to both of gears 218, 220, e.g., by being interposed between the gears, and is rotatable about an axis of rotation $A_3$ that is parallel to the rotational axes of gears 218, 220, as well as longitudinal axes of tubular spray elements 210, 212 (which, in the illustrated embodiment, are coaxial with one another and labeled $A_1$, $A_2$). Drive gear 252 includes a plurality of teeth 254 that engage with teeth 222, 224 of gears 218, 220 such that rotation of drive gear 252 rotates both gears 218, 220 in the same rotational direction to one another, which is opposite to that of drive gear 252. Gears 218, 220 and 252 rotate in a common plane, and it will be appreciated that the size and number of teeth of each gear may be varied in different embodiments to control the relative rotation of each gear. It will also be appreciated that in other embodiments, additional gears or other mechanical couplings may be disposed between any of gears 218, 220, 252, such that the operable coupling between the gears does not require that the gears be in direct contact with one another. Moreover, while tubular spray elements 210, 212 are illustrated as having longitudinal axes that are coaxial with the axes of rotation of gears 218, 220, the invention is not so limited. Moreover, other mechanical couplings, e.g., worm or screw drives, belt drives, chain drives, etc. may be used in other embodiments.

Drive gear 252 is also rotatably coupled to mounting bracket 234, e.g., through a sleeve 256 thereof. An axle 258, in particular, projects through sleeve 256 and a central aperture 260 of drive gear 252, and a gear cap 262 secures to both gear 252 (e.g., using pins 264 and mounting apertures 266) and axle 258, e.g., through engagement with a resilient catch 258*a* at the end of axle 258 (FIG. 14), thereby restricting relative rotation between drive gear 252 and axle 258.

Figure 13:
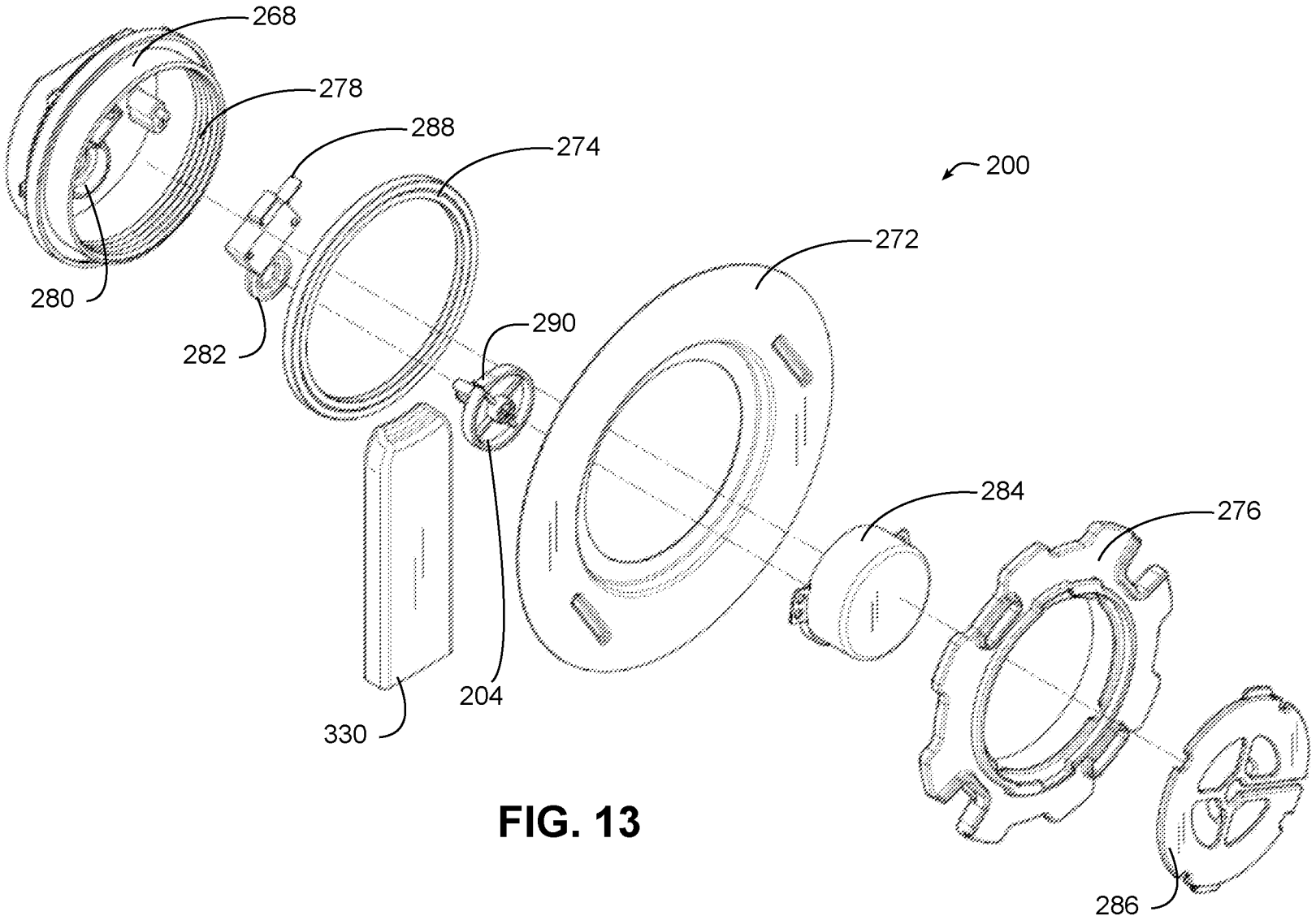
FIG. 13 is an exploded rear perspective view of the wall-mounted components of the tubular spray element spraying system of FIG. 10.
Figure 14:
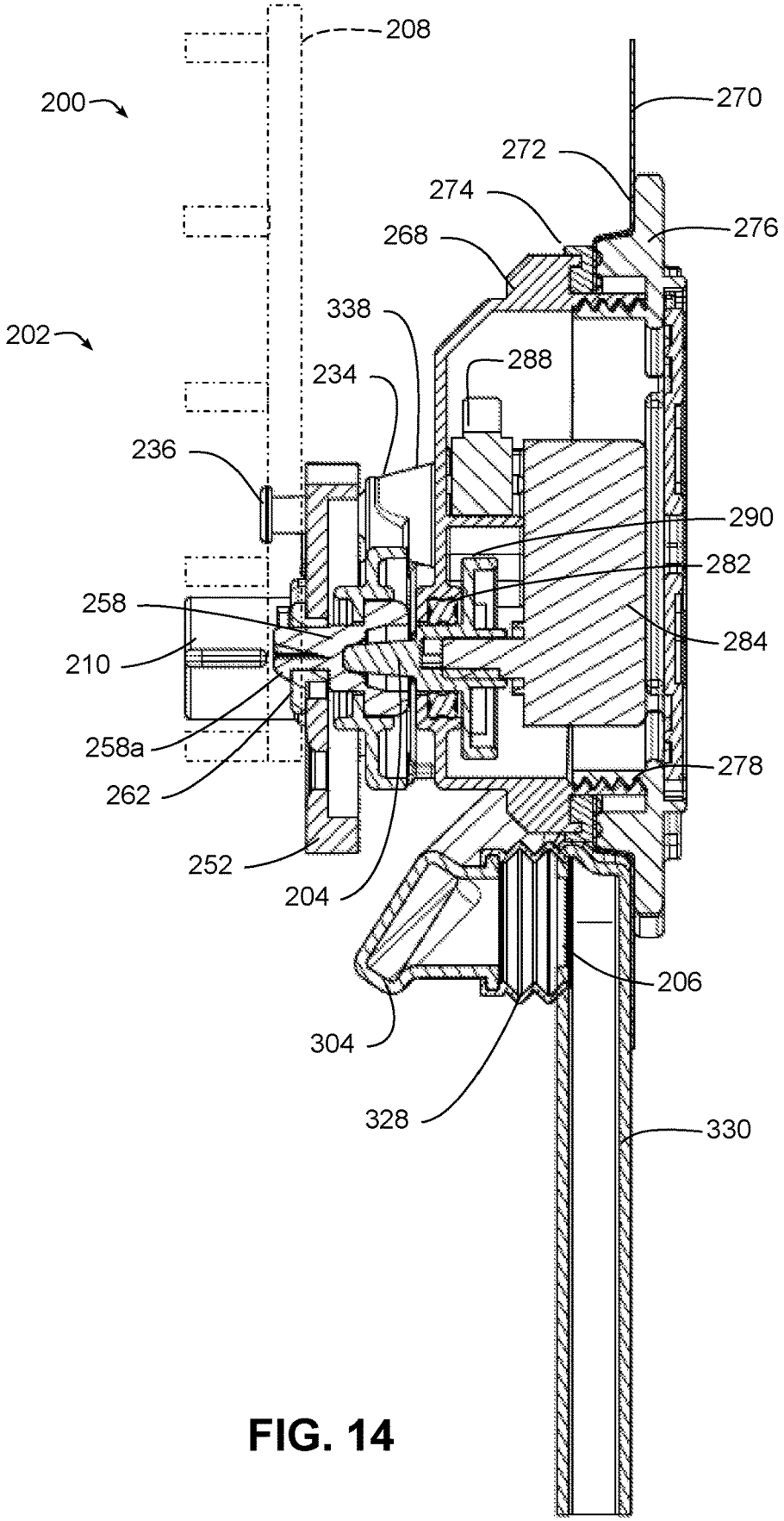
FIG. 14 is a cross-sectional view of the rack-mounted tubular spray element spraying system of FIG. 10, taken along lines 14-14 thereof.
Figure 15:
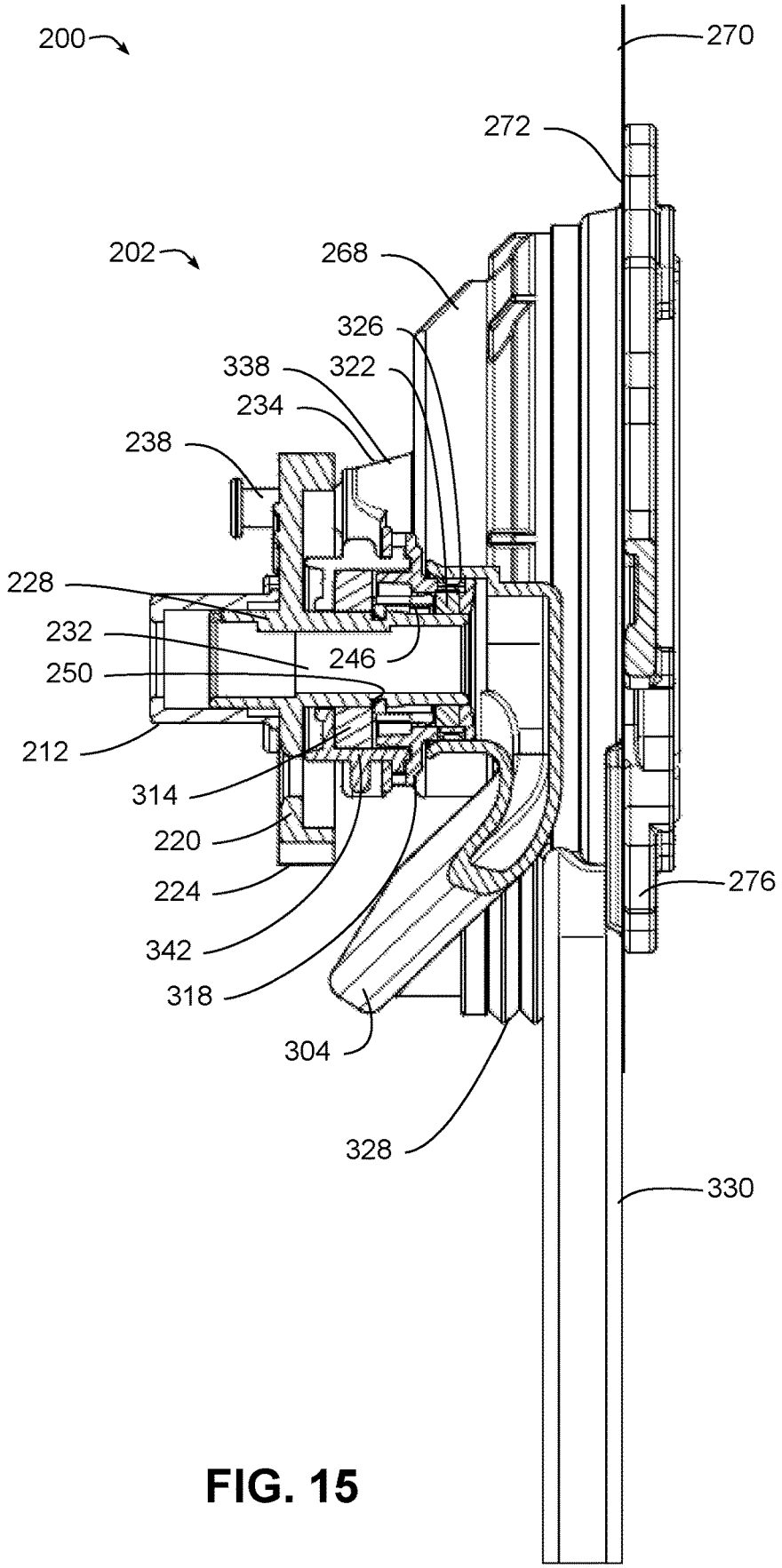
FIG. 15 is a cross-sectional view of the rack-mounted tubular spray element spraying system of FIG. 10, taken along lines 15-15 thereof.

With reference to FIGS. 11 and 13, rotatable drive member 204 projects from a motor housing 268 that is supported on a wall 270 of the dishwasher wash tub. Motor housing 268, in the illustrated embodiment, extends through a hole in the wash tub and is surrounded by a shroud 272 and sealed by a gasket 274. A nut 276 threadably engages inwardly-facing threads 278 of motor housing 268 to secure the motor housing to the wall of the wash tub.

Rotatable drive member 204 specifically projects through an aperture 280 of motor housing 268 and is sealed by a shaft seal 282 that allows for rotation of the rotatable drive member 204. An electric motor 284, which in some embodiments may include an integrated gearbox, drives rotatable drive member 204, and is mounted external to the wash tub within motor housing 268, with access to the motor provided through a panel 286 that secures to nut 276.

In some embodiments, motor 284 may be implemented as a stepper motor, while in other embodiments e.g., as illustrated in FIG. 13, a separate position sensor 288 may be used to sense the rotational position of rotatable drive member 204. In some embodiments, it may be desirable to utilize an encoder or other multi-position sensor; however, in the illustrated embodiment, position sensor 288 may be implemented using a microswitch that functions as a home sensor, and is driven by a cam 290 formed on rotatable drive member 204. Where only a home position is sensed, in some embodiments a known or empirically-determined rotational rate of motor 284 may be used to control positioning of each tubular spray element 210, 212 by controlling the amount of time the motor is activated after sensing the home position with position sensor 288.

Figure 16:
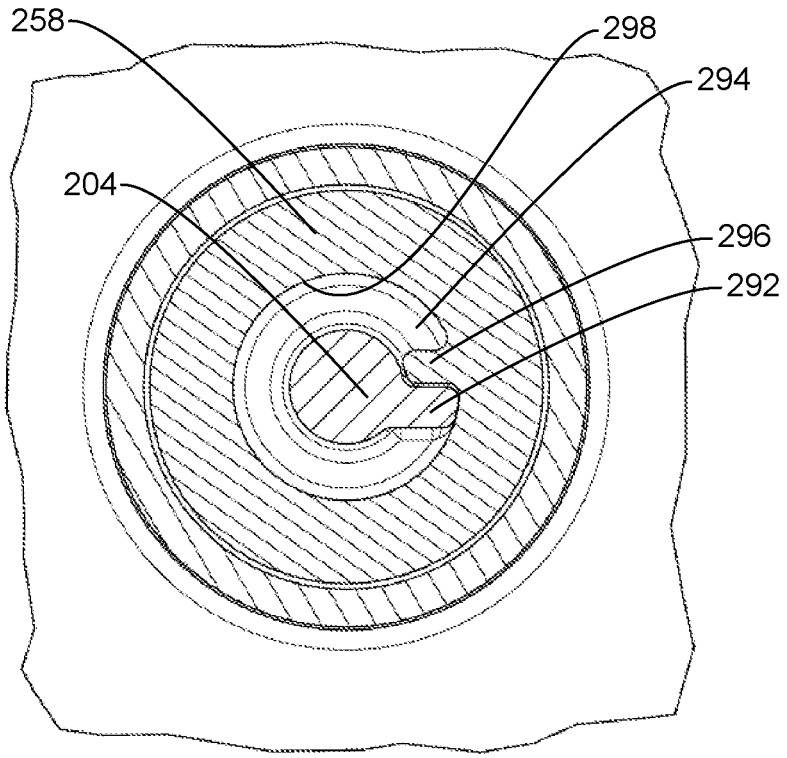
FIG. 16 is a cross-sectional view of the rack-mounted tubular spray element spraying system of FIG. 10, taken along lines 16-16 thereof.

Operable engagement between rotatable drive member 204 and drive gear 252 may be implemented in a number of different manners in different embodiments. With reference to FIG. 16, in the illustrated embodiment, a slip ring alignment arrangement is used to operably couple together rotatable drive member 204 and drive gear 252 when the rack 208 is in the washing position. With such an arrangement, rotatable drive member 204 includes a keyed shaft 292, while axle 258 is configured with a keyed slot 294 that mates with keyed shaft 292 of rotatable drive member 204. In the illustrated embodiment, keyed slot 294 is cylindrical in cross-section and includes a mating member 296 that extends inwardly from an inner wall 298 of keyed slot 294 along a radial direction and engages with keyed shaft 292 of rotatable drive member 204 when rotatable drive member 204 rotates about its rotational axis. By doing so, the slip ring alignment arrangement allows for rotatable drive member 204 to operably couple with drive gear 252 even in the event that either member rotates relative to the other when the rack is not in the washing position, but still enable the two components to establish a predetermined rotational relationship simply through rotation of the rotatable drive member at least one full revolution, and so long as the rotational position of the rotatable drive member is known or tracked and the rotational offset between the drive gear and the rotatable drive member when the two components are in rotational alignment with one another is known, the rotational position of the drive gear (and thus tubular spray elements 210, 212) can likewise be known or tracked.

Figure 17:
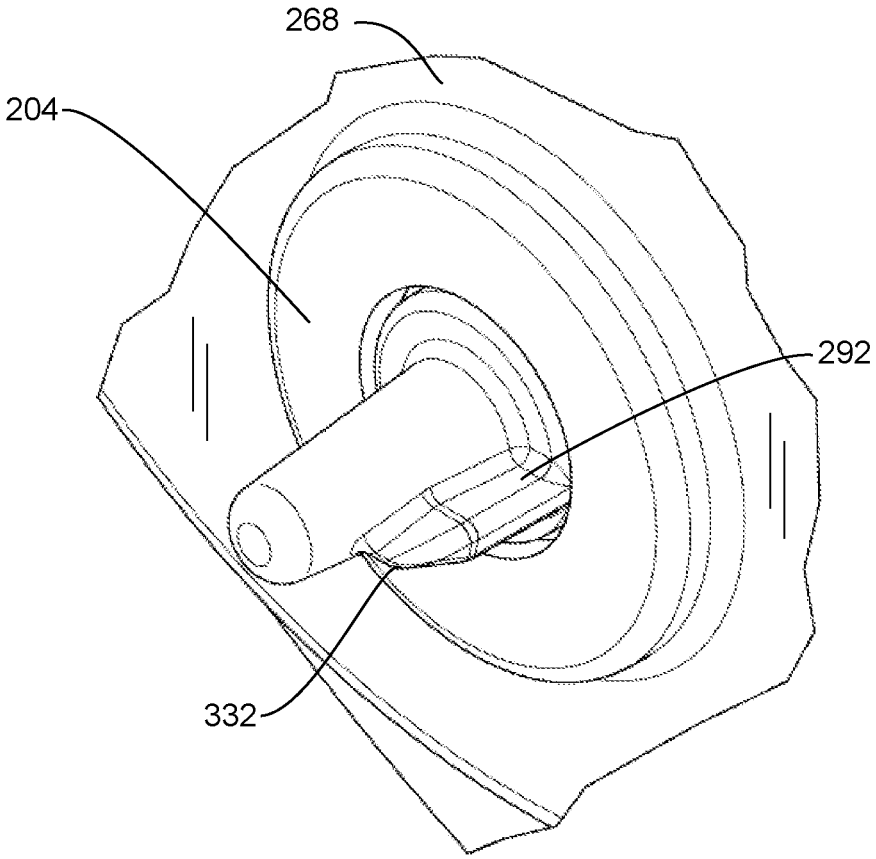
FIG. 17 is an enlarged perspective view of the rotatable drive member of FIG. 10.

In addition, as illustrated in FIG. 17, in some embodiments it may also be desirable to provide a beveled leading edge 332 on keyed shaft 292 to facilitate insertion of rotatable drive member 204 into keyed slot 294, specifically to avoid leading edge-to-leading edge contact between keyed shaft 292 and mating member 296 that could otherwise inhibit full insertion of keyed shaft 292 into keyed slot 294. A similar beveled leading edge may also be provided on mating member 296 in some embodiments, while in other embodiments, only one of keyed shaft 292 and mating member 296 may have a beveled leading edge. The beveled leading edge(s) therefore assist in deflecting keyed shaft 292 and/or mating member 296 as keyed shaft 292 is inserted into keyed slot 294 when the rack is pushed back into the washing position.

In addition, with reference to FIGS. 10-12, it may also be desirable in some embodiments to incorporate an additional alignment arrangement 334 that assists in aligning rack-mounted tubular spray element assembly 202 with wall-supported and electrical-motor driven rotatable drive member 204 and wall-supported fluid port 206. In the illustrated embodiment, for example, alignment arrangement 334 may include one or more wall-mounted projections 336, e.g., disposed on motor housing 268, and one or more complementary rack-mounted receivers 338, e.g., disposed on mounting bracket 234. Wall-mounted projections 336 in the illustrated embodiment are cone-shaped, while rack-mounted receivers 338 have complementary cone-shaped recesses that receive the projections when the rack is pushed back into the washing position, thereby aligning the rack-mounted and wall-mounted components in predetermined positions relative to one another.

With reference to FIG. 12, as noted above, tubular spray elements 210, 212 are respectively secured to gears 218, 220, e.g., through twist lock fittings 300, 302. Supply of wash fluid to the fluid inlets 214, 216 of tubular spray elements 210, 212 may be provided by a fluid manifold 304 that includes a manifold fluid inlet 306 and a pair of manifold fluid outlets 308, 310 in communication with manifold fluid inlet 306. In the illustrated embodiment, fluid manifold 304 is arranged with manifold fluid inlet 306 and manifold fluid outlets 308, 310 in a substantially U-shaped arrangement in a plane substantially parallel to wall 270, although the invention is not so limited. The U-shaped arrangement, among other benefits, allows for physical separation between rotatable drive member 204 and fluid port 206 on wall 270, as will be discussed in greater detail below.

As noted above, mounting bracket 234 includes a pair of sleeves 240, 242 that receive axles 226, 228 of gears 218, 220. A pair of sleeve bearings 312, 314 circumscribe each axle 226, 228 and allow for rotation thereof within sleeves 240, 242 of mounting bracket 234. Moreover, a pair of caps 316, 318 snap fit onto mounting bracket 324 with axles 226, 228 projecting therethrough, and retaining clips 244, 246 engage annular channels 248, 250 on axles 226, 228 to retain each gear 218, 220, and thus each tubular spray element 210, 212, on mounting bracket 234.

Caps 316, 318 further snap fit onto fluid manifold 304, and a pair of bracket gaskets 320, 322 and a pair of manifold gaskets 324, 326 provide a rotary seal that seals manifold fluid outlets 308, 310, such that wash fluid entering manifold fluid inlet 306 is communicated through manifold fluid outlets 308, 310, through caps 316, 318, through channels 230, 232 of axles 226, 228, and into fluid inlets 214, 216 of tubular spray elements 210, 212. As such, caps 316, 318 effectively secure manifold fluid outlets 308, 310 of fluid manifold 304 to sleeves 240, 242 of mounting bracket 234.

Thus, in the illustrated embodiment, fluid inlets 214, 216, manifold fluid outlets 308, 310, axles 226, 228, and channels 230, 232 are substantially coaxial along axes $A_1$ and $A_2$. It will be appreciated, however, that other arrangements may be used, so the invention is not so limited.

In the illustrated embodiment, a bellows 328 circumscribes manifold fluid inlet 306. With reference to FIG. 11, fluid port 206 is disposed on a fluid supply conduit 330 that is positioned such that when the rack is in the washing position, bellows 328 engages and seals fluid port 206 with fluid port 206 and manifold fluid inlet 306 opposite one another, thereby placing fluid port 206 in fluid communication with manifold fluid inlet 306.

In addition, in the illustrated embodiment, fluid supply conduit 330 extends along an inner surface of wall 270, such that wash fluid does not need to be supplied through the wall of the wash tub in order to supply tubular spray elements 210, 212. In addition, in the illustrated embodiment, fluid port 206 is physically separated from rotatable drive member 204 along a substantially vertical axis and at a lower elevation, although other arrangements may be used in other embodiments (e.g., with fluid port 206 at a higher elevation than rotatable drive member 204). An advantage of such a configuration is that the electrical components may be housed externally from the wash tub, while the fluid supply components may be maintained within the wash tub, thereby reducing the number of potential points of leakage through the wash tub.

Among other benefits, the herein-described arrangement places the tubular spray elements, gears, and associated drive train elements on a rack to eliminate the need for a support structure suspended from the wash tub, as well as to reduce the number of hydraulic docks and the overall system complexity to reduce cost and reliability concerns. In addition, in some embodiments, the herein-described arrangement may reduce the concern of unwanted dishware contact with rack movement by enabling tubular spray elements to be positioned close to the rack bottom, or even within recesses in the rack bottom, which in some instances may reduce or eliminate the need for any wash tub-mounted guards.

It will also be appreciated that, while certain features may be discussed herein in connection with certain embodiments and/or in connection with certain figures, unless expressly stated to the contrary, such features generally may be incorporated into any of the embodiments discussed and illustrated herein. Moreover, features that are disclosed as being combined in some embodiments may generally be implemented separately in other embodiments, and features that are disclosed as being implemented separately in some embodiments may be combined in other embodiments, so the fact that a particular feature is discussed in the context of one embodiment but not another should not be construed as an admission that those two embodiments are mutually exclusive of one another. Various additional modifications may be made to the illustrated embodiments consistent with the invention. Therefore, the invention lies in the claims hereinafter appended.

What is claimed is:

1. A dishwasher, comprising:

a wash tub;

a rack supported in the wash tub and movable between loading and washing positions;

a first tubular spray element supported at a first position on the rack and being rotatable about a first longitudinal axis, the first tubular spray element including a first plurality of apertures extending through a first exterior surface of the first tubular spray element and in fluid communication with a first fluid inlet;

a second tubular spray element supported at a second position on the rack and being rotatable about a second longitudinal axis, the second tubular spray element including a second plurality of apertures extending through a second exterior surface of the second tubular spray element and in fluid communication with a second fluid inlet;

a rotatable drive member supported on a wall of the wash tub;

an electric motor supported on the wall of the wash tub and configured to rotate the rotatable drive member;

a fluid port supported on the wall of the wash tub and physically separated from the rotatable drive member, the fluid port in fluid communication with a fluid supply; and a rack-mounted tubular spray element assembly supported by the rack, the rack-mounted tubular spray element assembly comprising:

a fluid manifold including a manifold fluid inlet in fluid communication with first and second manifold fluid outlets, the manifold fluid inlet positioned to receive fluid from the fluid port when the rack is disposed in the washing position, and the first and second manifold fluid outlets respectively in fluid communication with the first and second fluid inlets of the first and second tubular spray elements;

first and second gears respectively coupled to the first and second tubular spray elements to rotate the first and second spray elements about the respective first and second longitudinal axes; and a third gear operably coupled to the first and second gears and configured to be rotated by the rotatable drive member when the rack is disposed in the washing position to thereby rotate the first and second gears.

2. The dishwasher of claim 1, wherein the first, second and third gears each include teeth, wherein the teeth of the third gear engage the teeth of the first gear and the teeth of the second gear.

3. The dishwasher of claim 1, wherein the first and second gears respectively rotate about first and second axes of rotation that are substantially coaxial with the respective first and second longitudinal axes of the first and second tubular spray elements.

4. The dishwasher of claim 3, wherein the third gear is rotatable about a third axis of rotation that is parallel to each of the first and second axes of rotation.

5. The dishwasher of claim 4, wherein the third gear is interposed between the first and second gears and the first, second and third gears rotate in a common plane such that rotation of the third gear in a first direction about the third axis of rotation causes rotation of each of the first and second gears about the respective first and second axes of rotation in a second direction that is opposite that of the first direction.

6. The dishwasher of claim 3, wherein the first fluid inlet of the first tubular spray element, the first manifold fluid outlet, and the first axis of rotation are substantially coaxial with one another and the second fluid inlet of the second tubular spray element, the second manifold fluid outlet, and the second axis of rotation are substantially coaxial with one another.

7. The dishwasher of claim 1, wherein the rack-mounted tubular spray element assembly further includes a mounting bracket that supports the rack-mounted tubular spray element assembly on the rack, the mounting bracket including first, second and third sleeves respectively configured to rotatably support the first, second and third gears.

8. The dishwasher of claim 7, wherein the first and second gears respectively include first and second axles projecting respectively through the first and second sleeves of the mounting bracket and first and second retaining clips respectively secured to the first and second axles to secure the first and second gears to the mounting bracket, wherein the first and second axles respectively include first and second channels to convey wash fluid from the first and second manifold fluid outlets to the first and second fluid inlets of the first and second tubular spray elements.

9. The dishwasher of claim 8, wherein the rack-mounted tubular spray element assembly further includes first and second caps, the first cap configured to secure the first manifold fluid outlet to the first sleeve of the mounting bracket and the second cap configured to secure the second manifold fluid outlet to the second sleeve of the mounting bracket.

10. The dishwasher of claim 8, wherein the first and second tubular spray elements are respectively secured to the first and second axles of the first and second gears.

11. The dishwasher of claim 1, wherein the rotatable drive member includes a keyed shaft and the third gear includes a keyed slot that mates with the keyed shaft of the rotatable drive member when the rack is in the washing position.

12. The dishwasher of claim 11, wherein the keyed slot is cylindrical and includes mating member that extends inwardly from an inner wall of the keyed slot along a radial direction that engages with the keyed shaft when the rotatable drive member is rotated about a rotational axis thereof.

13. The dishwasher of claim 1, further comprising a motor housing supported on the wall of the wash tub and housing the electric motor.

14. The dishwasher of claim 13, wherein the rotatable drive member projects through the motor housing and is sealed by a shaft seal.

15. The dishwasher of claim 13, further comprising a position sensor disposed in the motor housing and configured to detect at least one rotational position of the rotatable drive member.

16. The dishwasher of claim 15, wherein the position sensor comprises a microswitch, and the dishwasher further comprises a cam coupled to the rotatable drive member and configured to selectively engage the microswitch at the at least one rotational position of the rotatable drive member.

17. The dishwasher of claim 13, further comprising a fluid supply conduit extending along the wall of the wash tub, wherein the fluid port is disposed on the fluid supply conduit opposite the manifold fluid inlet when the rack is in the washing position.

18. The dishwasher of claim 17, wherein the rack-mounted tubular spray element further includes a bellows circumscribing the manifold fluid inlet and configured to circumscribe the fluid port when the rack is in the washing position.

19. The dishwasher of claim 17, wherein the fluid supply conduit is disposed on an inner surface of the wall of the wash tub and extends along a substantially vertical axis, and wherein the fluid port is physically separated from the rotatable drive member along the substantially vertical axis.

20. The dishwasher of claim 19, wherein the manifold fluid inlet and the first and second manifold fluid outlets are arranged in a substantially U-shaped arrangement within a plane substantially parallel to the wall of the wash tub.

* * * * *